US010765272B2

(12) United States Patent
Mattheeussen et al.

(10) Patent No.: US 10,765,272 B2
(45) Date of Patent: Sep. 8, 2020

(54) SHEET PRODUCT DISPENSERS AND RELATED METHODS FOR REDUCING SHEET PRODUCT USAGE

(71) Applicant: GPCP IP Holdings LLC, Atlanta, GA (US)

(72) Inventors: Steven B. Mattheeussen, Fremont, WI (US); Genevieve Taylor, Shorewood, WI (US); Roy J. Rozek, Neenah, WI (US); Antonio M. Cittadino, Appleton, WI (US); Eric Peterson, Hortonville, WI (US); Ryan A. Goltz, Neenah, WI (US); John Laitala, Appleton, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 1252 days.

(21) Appl. No.: 14/821,215

(22) Filed: Aug. 7, 2015

(65) Prior Publication Data

US 2016/0037979 A1 Feb. 11, 2016

Related U.S. Application Data

(60) Provisional application No. 62/035,138, filed on Aug. 8, 2014.

(51) Int. Cl.

| | |
|---|---|
| ***A47K 10/38*** | (2006.01) |
| ***A47K 10/32*** | (2006.01) |
| ***A47K 10/36*** | (2006.01) |

(52) U.S. Cl.

CPC ..... *A47K 10/38* (2013.01); *A47K 10/3643* (2013.01); *A47K 10/3836* (2013.01); (Continued)

(58) Field of Classification Search

CPC ..... A47K 10/38; A47K 2010/3675; A47K 10/3836; A47K 2010/3872; (Continued)

(56) References Cited

U.S. PATENT DOCUMENTS

| | | | |
|---|---|---|---|
| 316,368 | A | 4/1885 | Johnson |
| 405,121 | A | 6/1889 | Ross |

(Continued)

FOREIGN PATENT DOCUMENTS

| | | |
|---|---|---|
| DE | 3310384 | 10/1983 |
| DE | 19841190 | 3/2000 |

(Continued)

OTHER PUBLICATIONS

International Search Report and Written Opinion of the International Searching Authority of PCT/US2015/044268, dated Oct. 21, 2015.

*Primary Examiner* — William A. Rivera
(74) *Attorney, Agent, or Firm* — Eversheds Sutherland (US) LLP

(57) ABSTRACT

A method of dispensing a user-determined length of sheet product from a roll of sheet product via a sheet product dispenser is provided. The method includes the steps of providing the roll of sheet product rotatably supported by the sheet product dispenser for dispensing sheet product therefrom, wherein the roll of sheet product rotates in response to a pull force applied to a tail portion of the roll of sheet product; and providing, via the sheet product dispenser, a pull force resistance opposing the rotation of the roll of sheet product, wherein the pull force resistance is between 36 grams-force and 96 grams-force throughout a majority of a life of the roll of sheet product.

36 Claims, 27 Drawing Sheets

(52) U.S. Cl.
CPC ..... *A47K 2010/3206* (2013.01); *A47K 2010/3233* (2013.01); *A47K 2010/3253* (2013.01); *A47K 2010/3675* (2013.01); *A47K 2010/3863* (2013.01); *A47K 2010/3872* (2013.01)

(58) Field of Classification Search
CPC ..... A47K 10/3643; A47K 2010/3863; A47K 2010/3253; A47K 2010/3206; A47K 2010/3233
See application file for complete search history.

(56) References Cited

U.S. PATENT DOCUMENTS 408,752 A 8/1889 Ross
417,592 A 12/1889 Seymour, Jr.
424,788 A 4/1890 Hubbell
429,029 A 5/1890 Geltz
432,107 A 7/1890 Yarger
436,789 A 9/1890 Jobes
444,342 A 1/1891 Everett
446,011 A 2/1891 Pickles
448,113 A 3/1891 Bolton
451,685 A 5/1891 Tracy
452,719 A 5/1891 Ross
476,689 A 6/1892 Sentman
643,375 A 2/1900 Hill
648,837 A 5/1900 Blue
649,062 A 5/1900 Levett et al.
661,114 A * 11/1900 Williams ..... B65H 75/28 242/422.5
802,145 A 10/1905 Hill
807,353 A 12/1905 Bretz
906,347 A * 12/1908 Willner ..... B65H 23/08 211/44
993,866 A * 5/1911 Page ..... B65D 5/728 206/308
1,063,787 A 6/1913 Evans
1,097,721 A 5/1914 Koch
1,207,280 A 12/1916 Currie
1,391,326 A 9/1921 Killian
1,624,235 A 4/1927 Hall
1,924,088 A 8/1933 Bowles
1,952,374 A 3/1934 Hill
2,416,585 A 2/1947 Holub
2,650,773 A 9/1953 Fanning
2,668,022 A 2/1954 Fairfield
2,699,903 A 1/1955 Montgomery
2,739,840 A 3/1956 Anderson
2,749,056 A 6/1956 Jenkins
2,752,106 A * 6/1956 Thompson ..... A61F 15/002 220/4.21
2,818,221 A 12/1957 Thieman
3,037,415 A 6/1962 Wyant
3,061,218 A * 10/1962 Moore ..... A47K 10/32 242/422.5
3,246,937 A 4/1966 Galbraith
3,291,354 A 12/1966 Ziebarth
3,347,480 A 10/1967 Abramoff
3,494,518 A 2/1970 Goss
3,516,615 A 6/1970 Wickenberg
3,649,447 A 3/1972 Turner
3,709,445 A 1/1973 Adams
3,770,221 A 11/1973 Stern
3,850,379 A 11/1974 Stern
3,918,661 A 11/1975 Kishi et al.
4,093,138 A 6/1978 Shafer
4,285,474 A * 8/1981 Perez ..... A47K 10/38 242/156.1
4,307,829 A 12/1981 Stoveken
4,610,407 A 9/1986 Stubbmann
4,660,781 A 4/1987 Hazard
4,666,099 A 5/1987 Hoffman et al.
4,706,844 A 11/1987 Omdoll et al.
4,714,210 A 12/1987 Howell
4,721,267 A 1/1988 Nieto et al.
4,771,966 A 9/1988 Anderson
4,781,316 A 11/1988 Freeberg
4,786,005 A 11/1988 Hoffman et al.
4,832,271 A * 5/1989 Geleziunas ..... A47K 10/3809 206/408
4,846,415 A 7/1989 Jernberg et al.
4,919,350 A 4/1990 Miller
5,054,675 A 10/1991 Taves
5,054,706 A 10/1991 Maurice
5,135,179 A 8/1992 Morano
5,205,454 A 4/1993 Schutz et al.
5,215,274 A 6/1993 Lin
5,249,755 A 10/1993 Jespersen
5,452,832 A 9/1995 Niada
5,651,487 A 7/1997 Hansen
5,755,397 A 5/1998 Freese
5,762,285 A 6/1998 Lin
5,788,136 A 8/1998 Othman
5,794,882 A 8/1998 Lewis
5,938,142 A 8/1999 Halperin
5,984,049 A 11/1999 Lammers
5,988,561 A 11/1999 Mele
6,098,919 A 8/2000 Lewis
6,202,956 B1 * 3/2001 Grasso ..... A47K 10/3836 242/560
6,267,322 B1 7/2001 Harmathy
6,398,151 B1 6/2002 Tam
6,439,501 B1 8/2002 Harmathy
6,550,714 B1 4/2003 Granger
6,648,265 B2 11/2003 Goldberg
6,666,364 B2 12/2003 Phelps
6,772,975 B2 8/2004 Sommerfeld et al.
6,786,377 B1 9/2004 Holden
6,805,271 B2 10/2004 Holden
6,793,097 B2 11/2004 Kamenstein
6,883,695 B2 4/2005 Orihara
7,063,245 B2 6/2006 Faulks et al.
7,090,106 B2 8/2006 Holden
7,101,441 B2 9/2006 Kennard
7,104,418 B2 9/2006 Kamenstein
7,185,842 B2 3/2007 Lewis et al.
7,290,733 B2 11/2007 Kamenstein et al.
7,314,194 B2 1/2008 Monosoff
7,350,742 B1 4/2008 Mariano et al.
7,392,917 B2 7/2008 Alalu et al.
7,438,257 B2 10/2008 Kennard
7,500,420 B2 3/2009 Cvjetkovic et al.
7,530,526 B1 5/2009 Powers
7,537,180 B2 5/2009 Morand
D635,806 S 4/2011 Bodum
7,984,872 B2 7/2011 Kuehneman et al.
8,162,252 B2 4/2012 Cittadino et al.
8,408,487 B2 4/2013 Rodrian et al.
8,444,080 B2 5/2013 Hagleitner
8,584,982 B2 11/2013 Eakin
2002/0100786 A1 8/2002 Orihara
2002/0130211 A1 9/2002 Kerr
2003/0019972 A1 * 1/2003 Goldberg ..... A47K 10/38 242/570
2005/0115979 A1 6/2005 Hellstrom et al.
2006/0071119 A1 4/2006 Zeitlin
2007/0262191 A1 11/2007 Amron
2008/0087759 A1 4/2008 Cittadino et al.
2008/0128448 A1 6/2008 Cittadino et al.
2009/0045280 A1 2/2009 Kennard
2010/0009826 A1 1/2010 Basin et al.
2011/0108598 A1 5/2011 Bruner
2012/0256036 A1 10/2012 Osborne
2013/0043266 A1 2/2013 Hagleitner
2013/0079923 A1 3/2013 Cittadino et al.
2013/0320128 A1 12/2013 Cittadino et al.
2015/0150422 A1 6/2015 Ochoa, Sr. et al.
2015/0374181 A1 12/2015 Morand

(56) References Cited

U.S. PATENT DOCUMENTS

| | | | | |
|---|---|---|---|---|
| 2016/0037979 | A1* | 2/2016 | Mattheeussen ..... | A47K 10/38<br>242/422.1 |
| 2016/0242603 | A1 | 8/2016 | Cvjetkovic | |

FOREIGN PATENT DOCUMENTS

| | | | |
|---|---|---|---|
| DE | 10200178 | | 7/2003 |
| EP | 0170768 | | 2/1986 |
| EP | 0965555 | | 12/1999 |
| EP | 2218383 | | 8/2010 |
| EP | 2586348 | | 5/2013 |
| EP | 2586349 | | 5/2013 |
| EP | 2586349 | A1 | 5/2013 |
| EP | 3031372 | A1 | 6/2016 |
| FR | 2621304 | A1 | 4/1989 |
| GB | 191226553 | | 11/1913 |
| GB | 784175 | | 10/1957 |
| GB | 2054518 | | 2/1981 |
| JP | 2004208765 | A | 7/2004 |
| WO | 9905952 | | 2/1999 |
| WO | 0065977 | | 11/2000 |
| WO | 2005120985 | | 12/2005 |
| WO | 2009050699 | | 4/2009 |

* cited by examiner

SHEET PRODUCT DISPENSERS AND RELATED METHODS FOR REDUCING SHEET PRODUCT USAGE

CROSS-REFERENCE TO RELATED APPLICATIONS

This application claims the benefit of U.S. Provisional Application No. 62/035,138, filed on Aug. 8, 2014, which is incorporated herein by reference in its entirety.

FIELD OF THE DISCLOSURE

The present disclosure relates generally to sheet product dispensers and more particularly to sheet product dispensers and related methods for reducing sheet product usage and for improving user experience.

BACKGROUND

Various types of sheet product dispensers are known in the art, including dispensers configured to allow a user to obtain a user-determined length of sheet product from a roll of sheet product supported by the dispenser. According to certain configurations, sheet product dispensers may be relatively simple mechanical devices including a roll support mechanism configured to rotatably support the roll for dispensing sheet product therefrom. During use of such dispensers, the user may grasp a "tail" portion (i.e., an exposed free end portion) of the roll and apply a pull force thereto sufficient to rotate the roll about the roll support mechanism and unwind a length of sheet product from the roll. The user may separate the unwound length of sheet product from the roll by tearing the sheet product along a predefined area of weakness, such as a line of perforations, or elsewhere as desired.

Some conventional sheet product dispensers may provide insignificant resistance opposing the pull force applied by the user and thus may allow "free-wheeling" of the roll of sheet product as it rotates about the roll support mechanism. In this manner, due to inertia, the roll may continue to rotate well after application of the pull force and well beyond a point necessary to unwind an adequate or intended length of sheet product, resulting in user frustration. Upon over-rotation of the roll, the user may rewind a portion of the sheet product or may simply separate the entire unwound length of sheet product. Ultimately, such dispensers may provide an undesirable user experience and/or may cause the user to knowingly or unknowingly dispense excess sheet product, resulting in considerable waste and increased cost to a provider of the sheet product.

Other conventional sheet product dispensers may provide significant resistance opposing the pull force applied by the user and thus may reduce or prevent free-wheeling and over-rotation of the roll of sheet product. However, the resistance may be intermittent and may vary significantly as the roll of sheet product rotates during a single use occasion, resulting in user frustration. Furthermore, the resistance may vary significantly over a life of the roll, as an outer diameter of the roll decreases, resulting in inconsistent user feel and perception from one use occasion to another. Ultimately, such dispensers may provide an undesirable user experience and may cause the user to knowingly or unknowingly dispense excess sheet product, resulting in considerable waste and increased cost to a provider of the sheet product.

There is thus a desire for improved sheet product dispensers and related methods for reducing sheet product usage and for improving user experience.

SUMMARY

In one aspect, a method is provided for dispensing a user-determined length of sheet product from a roll of sheet product via a sheet product dispenser. The method includes the steps of providing the roll of sheet product rotatably supported by the sheet product dispenser for dispensing sheet product therefrom, wherein the roll of sheet product rotates in response to a pull force applied to a tail portion of the roll of sheet product; and providing, via the sheet product dispenser, a pull force resistance opposing the rotation of the roll of sheet product, wherein the pull force resistance is between 36 grams-force and 96 grams-force throughout a majority of a life of the roll of sheet product.

In another aspect, a sheet product dispenser is provided for dispensing a user-determined length of sheet product from a roll of sheet product. The sheet product dispenser includes a roll support mechanism and a resistance mechanism. The roll support mechanism is configured to rotatably support the roll of sheet product for dispensing sheet product therefrom via a pull force applied by a user to a tail portion of the roll of sheet product and to provide a first pull force resistance opposing the pull force applied by the user. The resistance mechanism is configured to engage a portion of the roll of sheet product and to provide a second pull force resistance opposing the pull force applied by the user. A sum of the first pull force resistance and the second pull force resistance is between 36 grams-force and 96 grams-force throughout a majority of a life of the roll of sheet product.

In still another aspect, a method is provided for dispensing a length of sheet product from a roll of sheet product via a sheet product dispenser. The method includes the steps of providing the roll of sheet product rotatably supported by the sheet product dispenser for dispensing sheet product therefrom, wherein the roll of sheet product rotates in response to a pull force applied to a tail portion of the roll of sheet product; and providing, via the sheet product dispenser, a pull force resistance opposing the rotation of the roll of sheet product, wherein the pull force resistance is substantially constant throughout a majority of a life of the roll of sheet product.

In yet another aspect, a sheet product dispenser is provided for dispensing a length of sheet product from a roll of sheet product. The sheet product dispenser includes a roll support mechanism and a resistance mechanism. The roll support mechanism is configured to rotatably support the roll of sheet product for dispensing sheet product therefrom via a pull force applied by a user to a tail portion of the roll of sheet product and to provide a first pull force resistance opposing the pull force applied by the user. The resistance mechanism is configured to engage a portion of the roll of sheet product and to provide a second pull force resistance opposing the pull force applied by the user. A sum of the first pull force resistance and the second pull force resistance is substantially constant throughout a majority of a life of the roll of sheet product.

In still another aspect, a resistance mechanism is provided for a sheet product dispenser for dispensing a length of sheet product from a roll of sheet product rotatably supported by the sheet product dispenser. The resistance mechanism includes an arm and a spring. The arm is configured to frictionally engage a surface of the roll of sheet product. The spring is attached to the arm and configured to bias the arm into engagement with the surface of the roll of sheet product such that the resistance mechanism provides a pull force resistance opposing a pull force applied by a user to a tail portion of the roll of sheet product.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating examples of the disclosure, in which use of the same reference numerals indicates similar or identical items. Certain embodiments of the present disclosure may include elements, components, and/or configurations other than those illustrated in the drawings, and some of the elements, components, and/or configurations illustrated in the drawings may not be present in certain embodiments.

DETAILED DESCRIPTION

Figure 1:
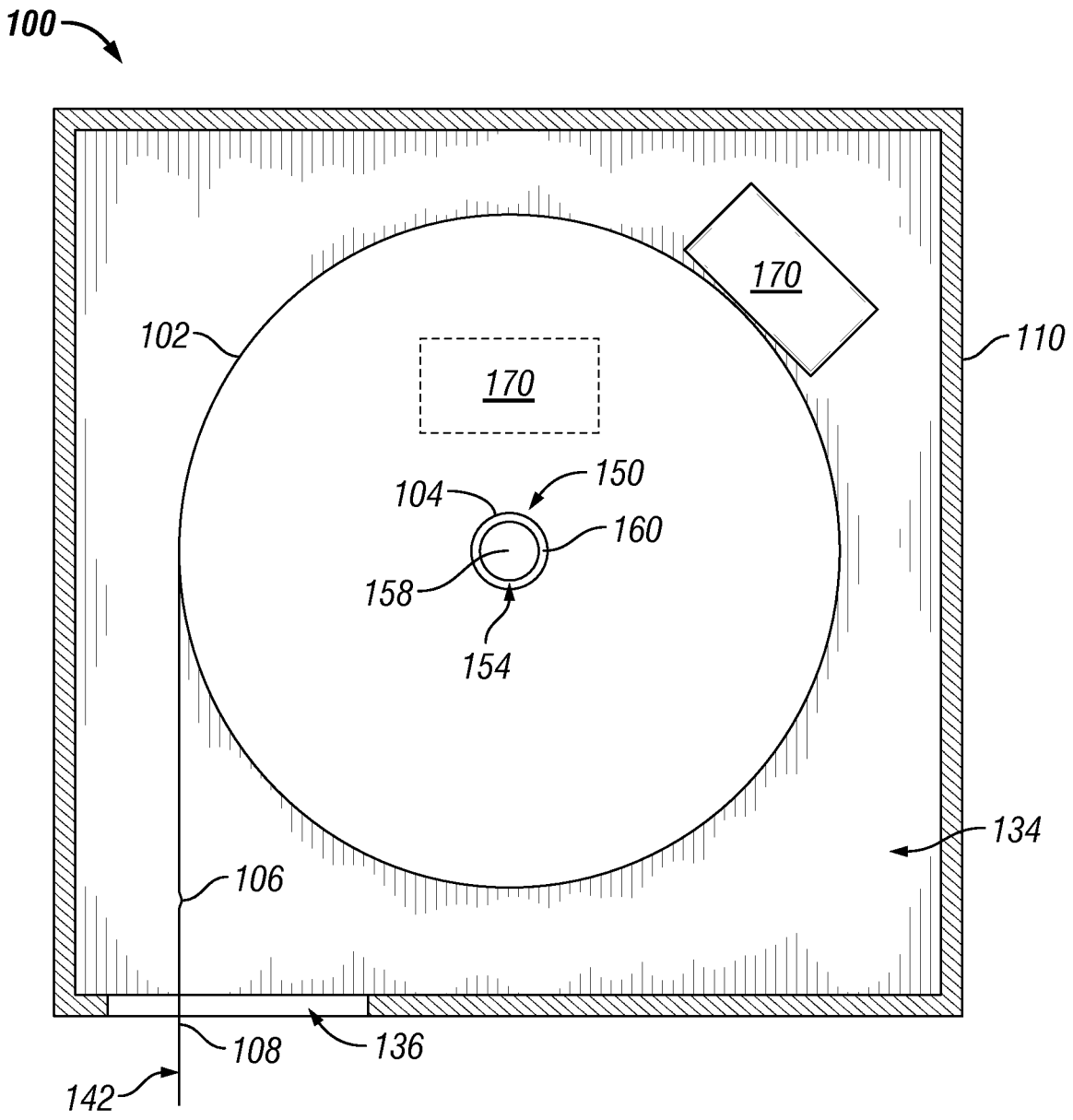
FIG. 1 is a schematic diagram of a sheet product dispenser in accordance with one or more embodiments of the disclosure.

It has been discovered that the amount of sheet product dispensed from a dispenser advantageously can be reduced by selectively controlling a pull force resistance provided by the dispenser. It also has been discovered that the pull force resistance provided by the dispenser advantageously can be controlled to be substantially constant throughout a life of a roll of sheet product dispensed thereby.

As described above, conventional sheet product dispensers and related methods for dispensing sheet product may provide resistance opposing a pull force applied by a user to rotate a roll of sheet product about a roll support mechanism and unwind a length of sheet product from the roll. For example, according to some dispensers, the roll support mechanism engages a central opening of the roll and provides rotational resistance opposing the pull force applied by the user. The rotational resistance may be relatively small, nearly nonexistent for some dispensers, and thus may have an insignificant effect on the pull force required to rotate the roll. Alternatively, the rotational resistance may be relatively large and thus may have a significant effect on the pull force required to rotate the roll. According to some dispensers, an additional resistance mechanism engages an outer surface of the roll and provides frictional resistance opposing the pull force applied by the user. The frictional resistance may be relatively small or relatively large and thus may have an insignificant or significant effect on the pull force required to rotate the roll. As is known, the rotational resistance and/or the frictional resistance provided by conventional sheet product dispensers may vary significantly over a life of the roll, as an outer diameter of the roll decreases, and thus the resulting effect on the pull force required to rotate the roll also may vary significantly. Ultimately, the total resistance provided by conventional sheet product dispensers and related methods may result in an undesirable user experience and/or may cause the user to knowingly or unknowingly dispense excess sheet product.

As compared to conventional sheet product dispensers and related methods for dispensing sheet product, the improved sheet product dispensers and methods described herein advantageously may reduce sheet product usage and improve user experience. In this manner, the improved sheet product dispensers and methods may reduce unnecessary waste of sheet product and decrease overall cost to a provider of the sheet product.

In particular, it has been surprisingly discovered that the length of sheet product dispensed per use occasion can be significantly reduced by providing certain levels of resistance opposing a pull force applied by a user to a tail portion of a roll of sheet product dispensed from a dispenser. For example, from about 20% to about 30% less sheet product may be used by providing a pull force resistance within a range of about 36 grams-force to about 96 grams-force. In particularly useful embodiments, the pull force resistance is within this range and is substantially constant over at least a majority (greater than 50%) of a life of the roll of sheet product.

The present disclosure includes various non-limiting embodiments of sheet product dispensers and related methods for dispensing sheet product, which reduce sheet product usage and improve user experience. The embodiments are described in detail herein to enable one of ordinary skill in the art to practice the sheet product dispensers and related methods, although it is to be understood that other embodiments may be utilized and that logical changes may be made without departing from the scope of the disclosure. Reference is made herein to the accompanying drawings illustrating some embodiments of the disclosure, in which use of the same reference numerals indicates similar or identical items. Throughout the disclosure, depending on the context, singular and plural terminology may be used interchangeably.

As used herein, the term "sheet product" is inclusive of natural and/or synthetic cloth or paper sheets. Sheet products may include both woven and non-woven articles. There are a wide variety of non-woven processes for forming sheet products, which can be either wetlaid or drylaid. Examples of non-woven processes include, but are not limited to, hydroentangled (sometimes called "spunlace"), double recreped (DRC), airlaid, spunbond, carded, papermaking, and melt-blown processes. Further, sheet products may contain fibrous cellulosic materials that may be derived from natural sources, such as wood pulp fibers, as well as other fibrous material characterized by having hydroxyl groups. Examples of sheet products include, but are not limited to, wipers, napkins, tissues, such as bath tissues, towels, such as paper towels, and other fibrous, film, polymer, or filamentary products. In general, sheet products are thin in comparison to their length and width and exhibit a relatively flat planar configuration but are flexible to permit folding, rolling, stacking, and the like. Sheet products may include predefined areas of weakness, such as lines of perforations, extending across their width between individual sheets to facilitate separation or tearing of one or more sheets from a roll or folded arrangement of the sheet product at discrete intervals. The individual sheets may be sized as desired to accommodate particular uses of the sheet product.

As used herein, the term "roll of sheet product" refers to a sheet product formed in a roll by winding layers of the sheet product around one another. Rolls of sheet product may have a generally circular cross-sectional shape, a generally oval cross-sectional shape, or other cross-sectional shapes according to various winding configurations of the layers of sheet product. Rolls of sheet product may be cored or coreless.

As used herein, the term "cored roll of sheet product" refers to a roll of sheet product that includes a core positioned therein. In this manner, the layers of the sheet product are wound around a core of paperboard or other material. A cored roll of sheet product includes a central opening extending therethrough along a longitudinal axis of the roll and defined by the core. A cored roll of sheet product may include one or more removable shafts, plugs, or other members positioned within the central opening for structural support during shipping or transportation, which may or may not be removed prior to loading the roll in or on a sheet product dispenser.

As used herein, the term "coreless roll of sheet product" refers to a roll of sheet product that does not include a core positioned therein. In this manner, the layers of the sheet product are not wound around a core of paperboard or other material. Instead, a coreless roll of sheet product includes a central opening extending therethrough along a longitudinal axis of the roll and defined by an inner layer of the sheet product itself. A coreless roll of sheet product may, however, include one or more removable shafts, plugs, or other members positioned within the central opening for structural support during shipping or transportation and removed prior to loading the roll in or on a sheet product dispenser.

As used herein, the term "life of a roll of sheet product" refers to a duration of time over which sheet product is available to be dispensed from a particular roll of sheet product. The roll life begins when sheet product is first available to be dispensed from the roll and ends when all of the sheet product of the roll that can be dispensed from the roll has been dispensed (e.g., excluding the last one or more layers that may be adhered to a core of a cored roll of sheet product).

As used herein, the term "pull force resistance" refers to a resistance opposing a pull force applied by a user to a tail portion of a roll of sheet product to rotate the roll and unwind a length of sheet product from the roll. In this manner, the pull force resistance resists rotation of the roll and unwinding of sheet product from the roll, and the pull force applied by the user must be greater than the pull force resistance in order to dispense sheet product from the roll.

As used herein in reference to the pull force resistance, the term "substantially constant" means that the pull force resistance varies by no more than ten percent (10%) from a mean value.

The meanings of other terms used herein will be apparent to one of ordinary skill in the art or will become apparent to one of ordinary skill in the art upon review of the detailed description when taken in conjunction with the several drawings and the appended claims.

Sheet Product Dispensers and Methods Providing a Desired Range of Pull Force Resistance FIG. 1 is a schematic diagram of a sheet product dispenser 100 according to one or more embodiments of the disclosure. The dispenser 100 is configured to allow a user to obtain a user-determined length of sheet product from a roll 102 of sheet product supported by the dispenser 100. The roll 102 of sheet product may be formed in a conventional manner, whereby layers of the sheet product are wound around one another. As is shown, the roll 102 of sheet product may be a coreless roll of sheet product, including a central opening 104 extending therethrough along a longitudinal axis of the roll 102 and defined by an inner layer of the sheet product. Alternatively, the roll 102 of sheet product may be a cored roll of sheet product, including a core (not shown) of paperboard or other material around which the layers of the sheet product are wound.

In some embodiments, the sheet product includes predefined areas of weakness 106, such as lines of perforations, extending across a width of the sheet product between individual sheets 108 thereof. In this manner, a user may separate one or more sheets 108 from the roll 102 by tearing the sheet product along one of the areas of weakness 106. In other embodiments, the sheet product includes no predefined areas of weakness, such that the sheet product is formed as a continuous sheet. In this manner, a user may separate a length of sheet product from the roll 102 by tearing the sheet product at any desired location, as may be achieved by an abrupt pulling action and as may be facilitated by a tear bar (not shown) or other cutting mechanism.

The sheet product dispenser 100 includes a housing 110, and the roll 102 of sheet product may be disposed completely, or at least partially, within the housing 110 for dispensing sheet product therefrom. The housing 110 may include a number of walls and may define an interior space 134 configured to receive the roll 102 of sheet product therein. As is shown, the housing 110 includes a dispenser opening 136 defined in one or more of the walls. During use of the dispenser 100, a tail portion 142 of the roll 102 may extend through the dispenser opening 136 and out of the housing 110, such that the tail portion 142 may be easily grasped and pulled by a user.

As is shown, the sheet product dispenser 100 also includes a roll support mechanism 150 configured to rotatably support the roll 102 of sheet product for dispensing therefrom. The roll support mechanism 150 may extend at least partially into the central opening 104 of the roll 102. According to various embodiments, the roll support mechanism 150 is fixedly or removably connected to the housing 110. In this manner, upon loading the roll 102 onto the roll support mechanism 150, the roll 102 is oriented in an appropriate manner to allow the tail portion 142 to extend through the dispenser opening 136 and out of the housing 110. In some embodiments, the roll support mechanism 150 includes a spindle 154 configured to rotatably support the roll 102 of sheet product. The spindle 154 may include a spindle shaft 158 and a spindle sleeve 160 rotatably disposed about the spindle shaft 158. The spindle sleeve 160 may frictionally engage and securely grip the central opening 104 of the roll 102 supported thereby, such that the spindle sleeve 160 rotates with the roll 102 during dispensing of sheet product therefrom. Alternatively, the spindle 154 may include the spindle shaft 158 but not the spindle sleeve 160, such that the spindle shaft 158 engages the central opening of the roll 102 supported thereby. In some embodiments in which the roll 102 is a cored roll, an insert is positioned within the central opening 104 of the roll 102 (i.e., the central opening 104 defined by the core) and configured to be positioned over at least a portion of the roll support mechanism 150 to attach the roll 102 to the roll support mechanism 150. The insert may frictionally engage and securely grip the central opening 104, such that the insert rotates with the roll 102 during dispensing of sheet product. Alternatively, the insert may frictionally engage and securely grip a mating portion of the roll support mechanism 150, such that the insert remains stationary as the roll 102 frictionally rotates about the insert during dispensing of sheet product. The insert may be provided as a separate component from the roll 102 and the roll support mechanism 150 or may be provided as a part of the roll support mechanism.

The roll support mechanism 150 also may include additional components configured to resist rotation of the spindle sleeve 160. In some embodiments, the roll support mechanism 150 includes a pawl configured to engage a ratchet gear of the spindle sleeve 160 and thereby resist rotation of the spindle sleeve 160. The pawl may be biased into engagement with the ratchet gear via a biasing element, such as a spring, which may be adjustable. In some embodiments, the roll support mechanism 150 includes a generator or an electrical clutch configured to engage the spindle sleeve 160 and resist rotation thereof. The resistance provided by the generator or the electrical clutch may be adjustable and may vary as a function of a speed at which the spindle sleeve 160 is rotated. In some embodiments, the roll support mechanism 150 includes a mechanical clutch configured to engage the spindle sleeve 160 and resist rotation thereof. The resistance provided by the mechanical clutch may be adjustable and may vary as a function of a speed at which the spindle sleeve 160 is rotated.

In addition to the roll support mechanism 150, the sheet product dispenser 100 includes a resistance mechanism 170 configured to engage one or more portions of the roll 102 of sheet product. In some embodiments, the dispenser 100 includes a plurality of resistance mechanisms 170 configured to engage one or more portions of the roll 102. In some embodiments, the resistance mechanism 170 is configured to engage an outer surface of the roll 102, as is shown via solid lines. In other embodiments, the resistance mechanism is configured to engage an end surface of the roll 102, as is shown via dashed lines. According to various embodiments, the resistance mechanism 170 is positioned above the roll 102, below the roll 102, in front of the roll 102, behind the roll 102, along an end of the roll 102, or otherwise with respect to the roll 102. The resistance mechanism 170 may be configured to frictionally engage a surface of the roll 102 as the roll 102 rotates during dispensing. Specifically, the resistance mechanism 170 may include an engagement member configured to frictionally engage the surface of the roll 102 throughout a life of the roll 102, or throughout a majority of the life of the roll 102. In some embodiments, the resistance mechanism 170 also includes a biasing member configured to bias the engagement member into engagement with the surface of the roll 102. For example, the resistance mechanism 170 may be configured in a manner similar to the resistance mechanism 270 described below, including an engagement member, such as an arm 274, and a biasing member, such as a torsion spring 280. As another example, the resistance mechanism 170 may be configured in a manner similar to the resistance mechanism 400 described below, including an engagement member, such as an arm 404, and a biasing member, such as a spring 410. In other embodiments, the resistance mechanism 170 is configured such that the engagement member is biased into engagement with the surface of the roll 102 due to the force of gravity. For example, the resistance mechanism 170 may be configured in a manner similar to the resistance mechanism 370 described below, including an engagement member, such as a load member 274 configured to move along a defined path.

Various other configurations of the resistance mechanism 170 may be used to frictionally engage the outer surface or one or both of the end surfaces of the roll 102. In some embodiments, the engagement member is a pressure plate configured to frictionally engage the outer surface or one or both of the end surfaces of the roll 102. The pressure plate may be biased into engagement with the respective surface of the roll 102 via a biasing member, such as a compression spring, an extension spring, a torsion spring, a constant-force coil spring, an elastic element, or any other mechanical element or mechanism for biasing the pressure plate. Alternatively, the pressure plate may be biased into engagement with the respective surface of the roll 102 via an adjustable biasing mechanism, such as a cam mechanism or a magnetic mechanism that may be adjusted to apply a desired biasing force to the pressure plate. In this manner, the resulting frictional forces generated between the pressure plate and the roll 102 may be adjustable. In some embodiments, the engagement member is one or more rollers configured to frictionally engage the outer surface of the roll 102. In one example, the roller is supported by a pivoting arm configured such that the roller is biased into engagement with the roll 102 due to the force of gravity. In another example, the roller is positioned below the roll 102, and the roll support mechanism 150 may be configured such that the roll 102 is biased into engagement with the roller due to the force of gravity. This configuration may be achieved by including a guide track configured to allow the spindle 154 to translate downward toward the roller as sheet product is depleted from the roll 102. In some embodiments, the engagement member is a support plate positioned below the roll 102, and the roll support mechanism 150 may be configured such that the roll 102 is biased into engagement with the support plate due to the force of gravity. The support plate may include a base portion configured to support and frictionally engage a bottom of the roll 102 and one or more ribs configured to frictionally engage the tail portion 142 of the roll 102 as it is pulled by a user. In some embodiments, the engagement member is a pair of rollers configured to frictionally engage the tail portion 142 of the roll 102. For example, the rollers may form a nip configured to receive the tail portion 142 therethrough. One of the rollers may be biased toward the other roller, such as by a biasing member or due to the force of gravity.

During use of the dispenser 100, a user grasps and applies a pull force to the tail portion 142 of the roll 102 of sheet product sufficient to rotate the roll 102 about the roll support mechanism 150 and unwind a length of sheet product from the roll 102. The roll support mechanism 150 may be configured to provide a pull force resistance opposing the pull force applied by the user. The pull force resistance provided by the roll support mechanism 150 may be a function of an outer diameter of the roll 102 and a rotational resistance generated by the roll support mechanism 150. Based on the configuration of the roll support mechanism 150, the rotational resistance may result from frictional forces generated between one or more rotating components and one or more stationary components of the roll support mechanism 150 and/or between the roll 102 and one or more stationary components of the roll support mechanism 150 as the roll 102 rotates. For example, according to embodiments in which the roll support mechanism 150 includes the spindle shaft 158 and the spindle sleeve 160, the rotational resistance may result, at least partially, from frictional forces generated between the spindle sleeve 160 and the spindle shaft 158 as the spindle sleeve 160 rotates with the roll 102 about the spindle shaft 158.

The pull force resistance provided by the roll support mechanism 150 may vary throughout a life of the roll 102 of sheet product, as the outer diameter of the roll 102 decreases. As described above, the pull force resistance provided by the roll support mechanism 150 may be a function of the outer diameter of the roll 102 and the rotational resistance generated by the roll support mechanism 150. As will be understood, based on the configuration of the roll support mechanism 150, the rotational resistance generated by the roll support mechanism 150 may be substantially constant throughout the life of the roll 102. Accordingly, as the outer diameter of the roll 102 decreases, the pull force resistance provided by the roll support mechanism 150 may increase.

During use of the dispenser 100, the resistance mechanism 170 is configured to provide a pull force resistance opposing the pull force applied by the user. The pull force resistance provided by the resistance mechanism 170 may be a function of a frictional resistance generated by the resistance mechanism 170 and the portion of the roll 102 engaged thereby. Based on the configuration of the resistance mechanism 170, the frictional resistance may result from frictional forces generated between the engagement member and the surface of the roll 102 engaged thereby as the roll 102 rotates about the roll support mechanism 150.

The pull force resistance provided by the resistance mechanism 170 may vary or may be substantially constant throughout the life of the roll 102 of sheet product, as the outer diameter of the roll 102 decreases. As described above, the pull force resistance provided by the resistance mechanism 170 may be a function of the frictional resistance generated by the resistance mechanism 170 and the portion of the roll 102 engaged thereby. In some embodiments, the frictional forces generated between the engagement member and the surface of the roll 102 engaged thereby decrease throughout the life of the roll 102. For example, according to embodiments in which the resistance mechanism 170 includes a biasing member, the frictional forces may decrease as the biasing member releases stored energy and moves toward a natural state. In other embodiments, the frictional forces generated between the engagement member and the surface of the roll 102 engaged thereby are substantially constant throughout the life of the roll 102. For example, according to embodiments in which the engagement member is biased into engagement with the surface of the roll 102 due to the force of gravity, the frictional forces may be substantially constant as the engagement member moves along a defined path.

In a preferred embodiment, a sum of the pull force resistance provided by the roll support mechanism 150 and the pull force resistance provided by the resistance mechanism 170 is within a range of 36 grams-force and 96 grams-force, a range of 46 grams-force and 86 grams-force, or a range of 56 grams-force and 76 grams-force, throughout the life of the roll 102 or throughout a majority of the life of the roll 102. In this manner, a total pull force resistance provided by the dispenser 100 (and thus experienced by the user when applying the pull force to the tail portion 142 of the roll 102) is, in a preferred embodiment, within a range of 36 grams-force and 96 grams-force, a range of 46 grams-force and 86 grams-force, or a range of 56 grams-force and 76 grams-force throughout the life of the roll 102 or throughout a majority of the life of the roll 102.

In some embodiments, the pull force resistance provided by the roll support mechanism 150 is relatively small and thus constitutes a relatively small portion of the total pull force resistance provided by the dispenser 100. In other embodiments, the pull force resistance provided by the roll support mechanism 150 is relatively large and thus constitutes a relatively large portion of the total pull force resistance provided by the dispenser 100. In some embodiments, the resistance mechanism 170 is omitted from the dispenser 100, and thus the pull force resistance provided by the roll support mechanism 150 constitutes the entirety of the total pull force resistance provided by the dispenser 100. In some embodiments, the pull force resistance provided by the roll support mechanism 150 is within a range of 5 grams-force and 35 grams-force throughout the life of the roll 102 or throughout a majority of the life of the roll 102. In some embodiments, the pull force resistance provided by the roll support mechanism 150 varies from between 5 grams-force and 25 grams-force at the beginning of the life of the roll 102 (i.e., when the roll 102 is full) to between 15 grams-force and 35 grams-force at the end of the life of the roll (i.e., when the roll 102 is completely depleted). The materials, surface treatments, dimensions, and mating contact areas of the rotating components and the stationary components of roll support mechanism 150 may be selected such that the pull force resistance provided by the roll support mechanism 150 is within a desired range throughout the life of the roll 102, or throughout a majority of the life of the roll 102.

In some embodiments, the pull force resistance provided by the resistance mechanism 170 is relatively small and thus constitutes a relatively small portion of the total pull force resistance provided by the dispenser 100. In other embodiments, the pull force resistance provided by the resistance mechanism 170 is relatively large and thus constitutes a relatively large portion of the total pull force resistance provided by the dispenser 100. In some embodiments, the roll support mechanism 150 is omitted from the dispenser 100, and thus the pull force resistance provided by the resistance mechanism 170 constitutes the entirety of the total pull force resistance provided by the dispenser 100. In some embodiments, the pull force resistance provided by the resistance mechanism 170 is within a range of 35 grams-force and 90 grams-force throughout the life of the roll 102 or throughout a majority of the life of the roll 102. In some embodiments, the pull force resistance provided by the resistance mechanism 170 varies from between 75 grams-force and 90 grams-force at the beginning of the life of the roll 102 to between 35 grams-force and 50 grams-force at the end of the life of the roll. The spring constant (i.e., stiffness) of the biasing member (if present) and the materials, surface treatments, dimensions, and mating contact area of the engagement member may be selected such that the pull force resistance provided by the resistance mechanism 170 is within a desired range throughout the life of the roll 102, or throughout a majority of the life of the roll 102.

Figure 2A:
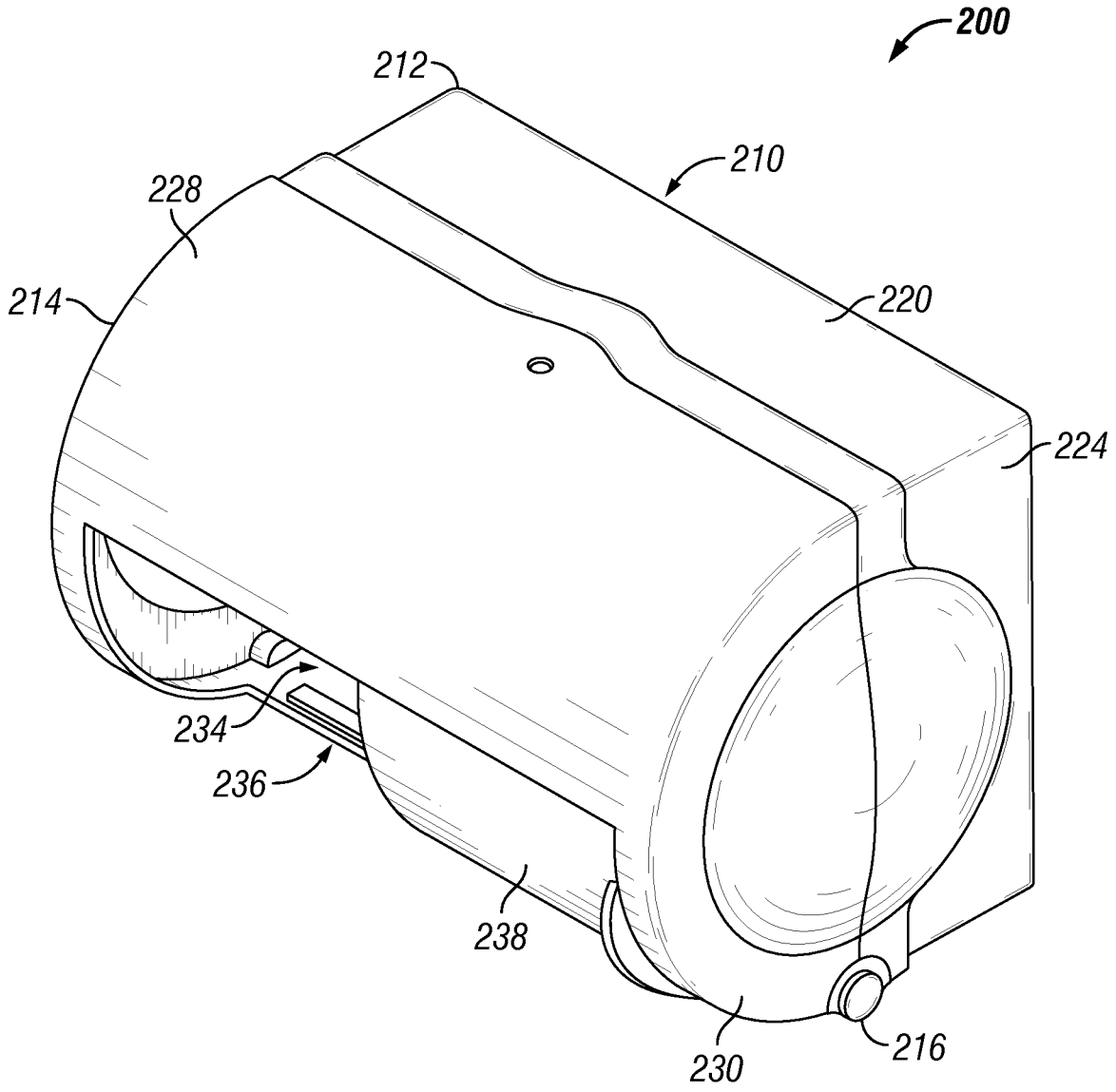
FIG. 2A is a perspective view of a sheet product dispenser in accordance with one or more embodiments of the disclosure, showing a first housing portion of the dispenser in a closed position for dispensing.
Figure 2B:
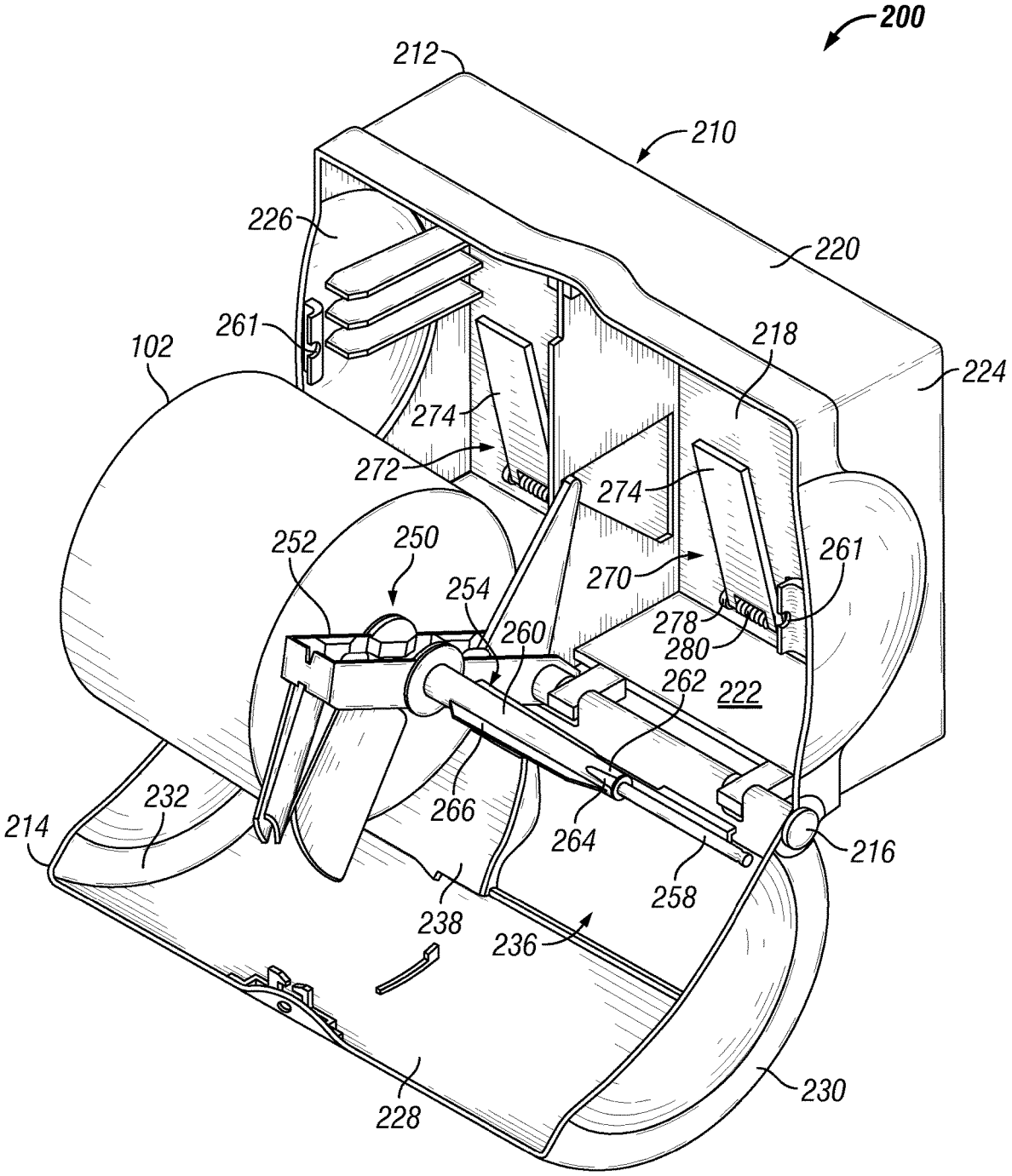
FIG. 2B is a perspective view of the sheet product dispenser of FIG. 2A, showing the first housing portion in an open position and a roll support mechanism of the dispenser in an extended position for loading rolls of sheet product thereon.
Figure 2C:
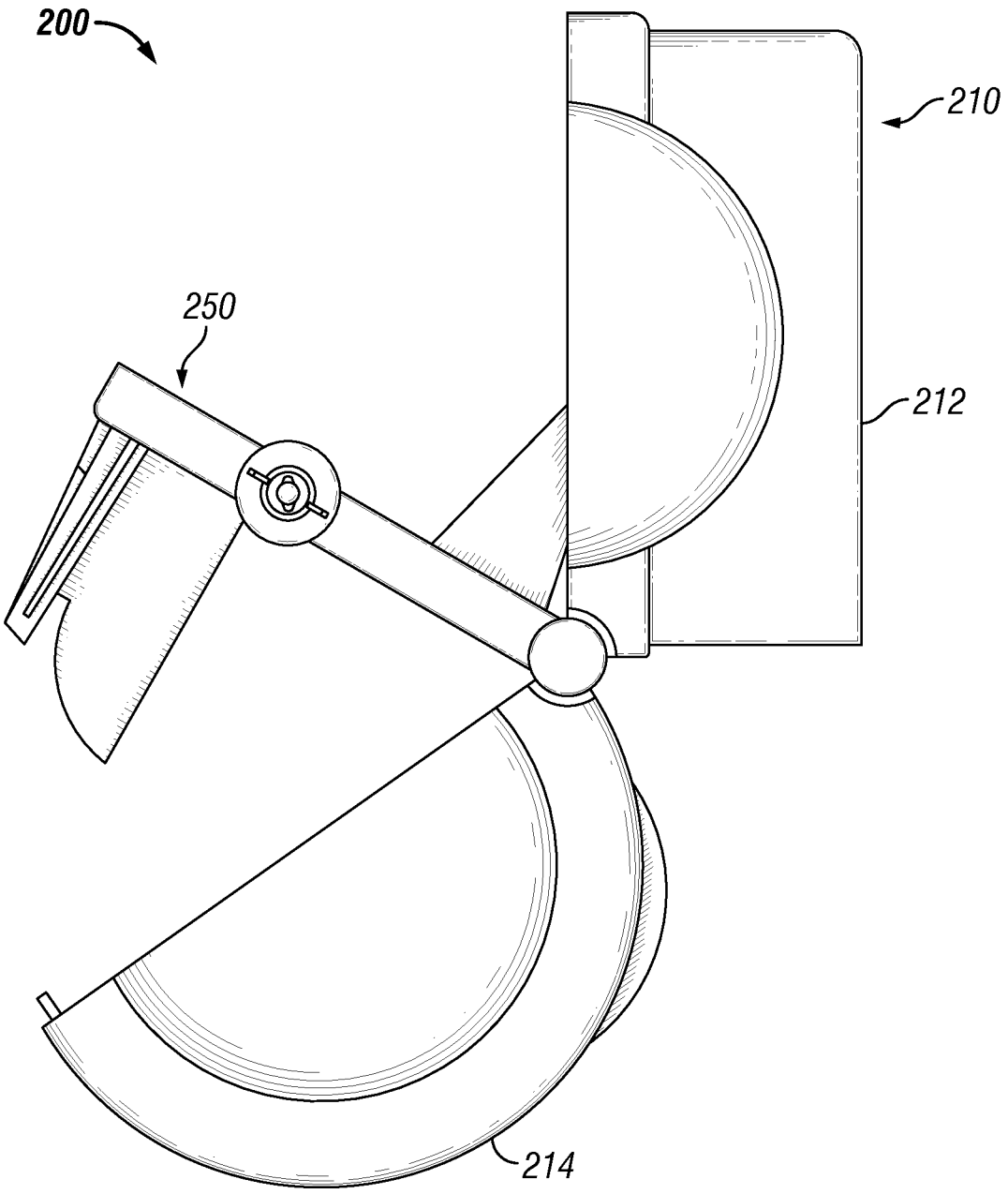
FIG. 2C is a side view of the sheet product dispenser of FIG. 2A, showing the first housing portion in the open position and the roll support mechanism in the extended position.

FIGS. 2A-2G show a sheet product dispenser 200 according to one or more embodiments of the disclosure. Similar to the dispenser 100, the dispenser 200 is configured to allow a user to obtain a user-determined length of sheet product from a roll 102 of sheet product supported by the dispenser 200. The sheet product dispenser 200 includes a housing 210, and the roll 102 of sheet product may be disposed completely, or at least partially, within the housing 210 for dispensing sheet product therefrom. The housing 210 may include a back or first housing portion 212 configured to attach to a wall or other support surface for mounting the dispenser 200 thereto. The housing 210 also may include a front or second housing portion 214 pivotally connected to the first housing portion 212 and configured to move between a closed position for dispensing sheet product, as is shown in FIG. 2A, and an open position for loading a roll 102 of sheet product, as is shown in FIG. 2B. Specifically, the second housing portion 214 may be configured to pivot about a pivot shaft 216 to which the first and second housing portions 212, 214 are connected. As is shown, the first housing portion 212 may include a back wall 218, a top wall 220, a bottom wall 222, a first side wall 224, and a second side wall 226. The second housing portion 214 may include a front wall 228, a first side wall 230, and a second side wall 232.

Figure 2D:
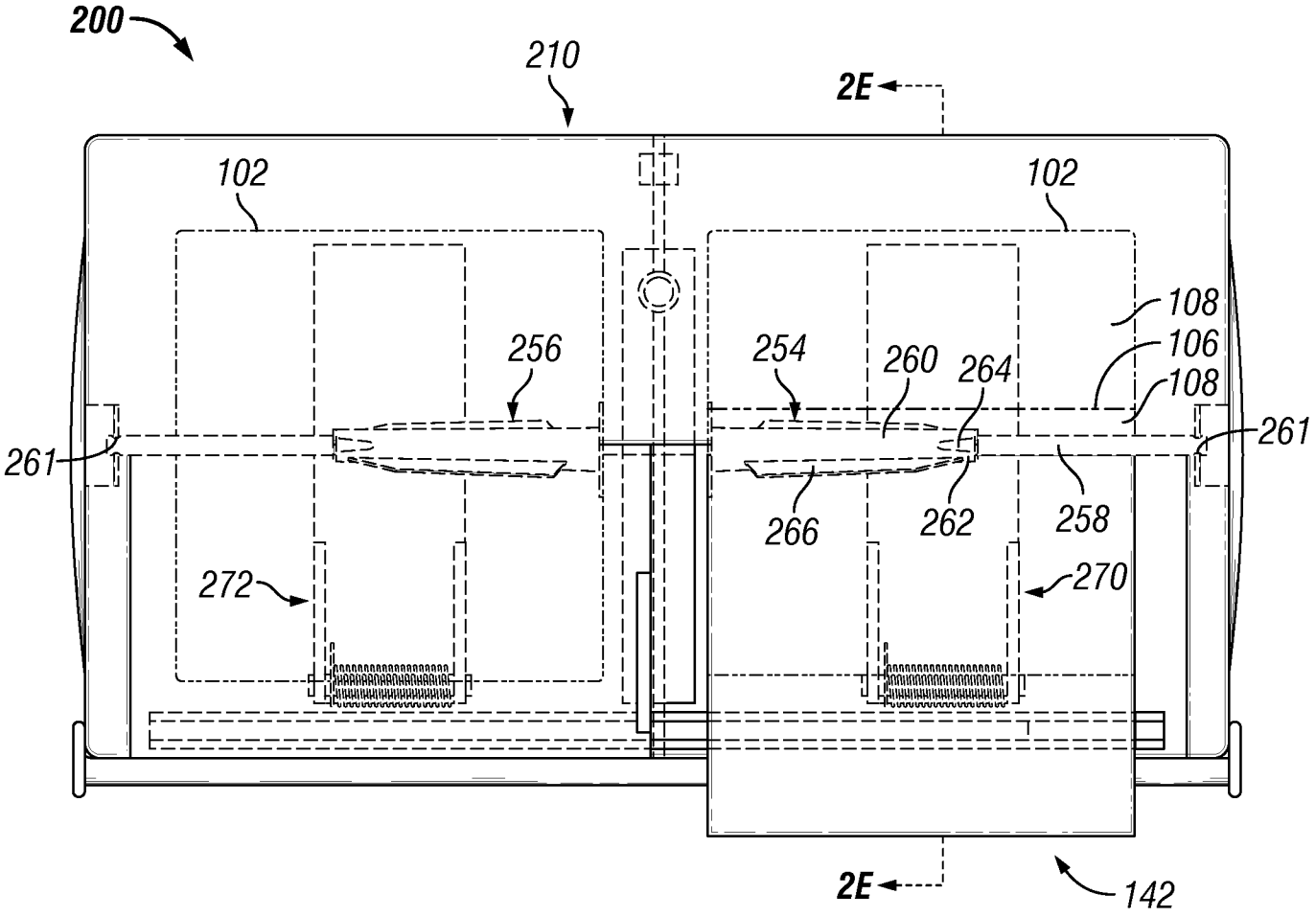
FIG. 2D is a front view of the sheet product dispenser of FIG. 2A, showing the first housing portion in the closed position and the roll support mechanism in a retracted position with two rolls of sheet product loaded thereon for dispensing.
Figure 2E:
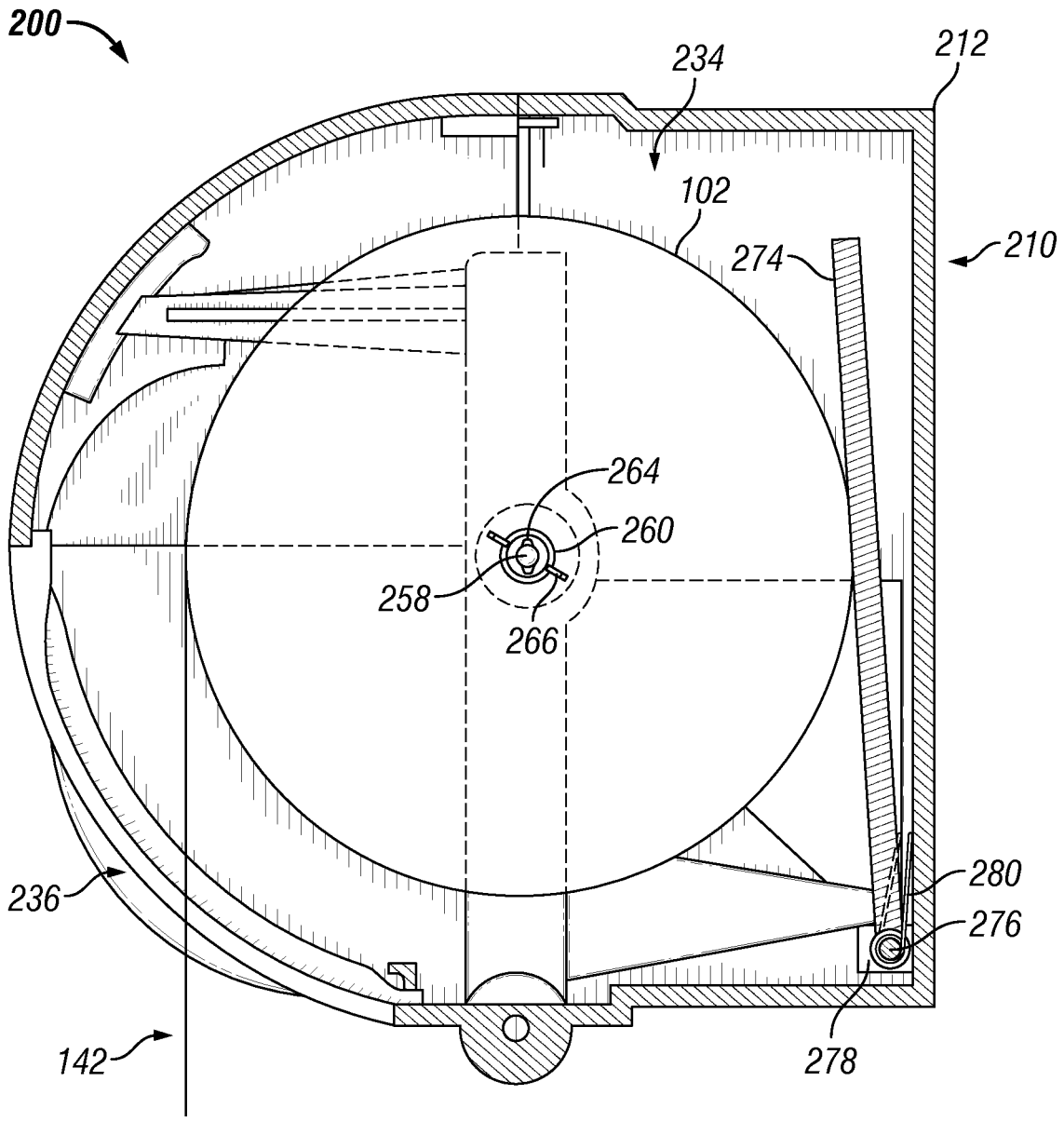
FIG. 2E is a side cross-sectional view of the sheet product dispenser taken along line 2E-2E in FIG. 2D, showing a resistance mechanism of the dispenser engaging a roll of sheet product that is substantially full.
Figure 2F:
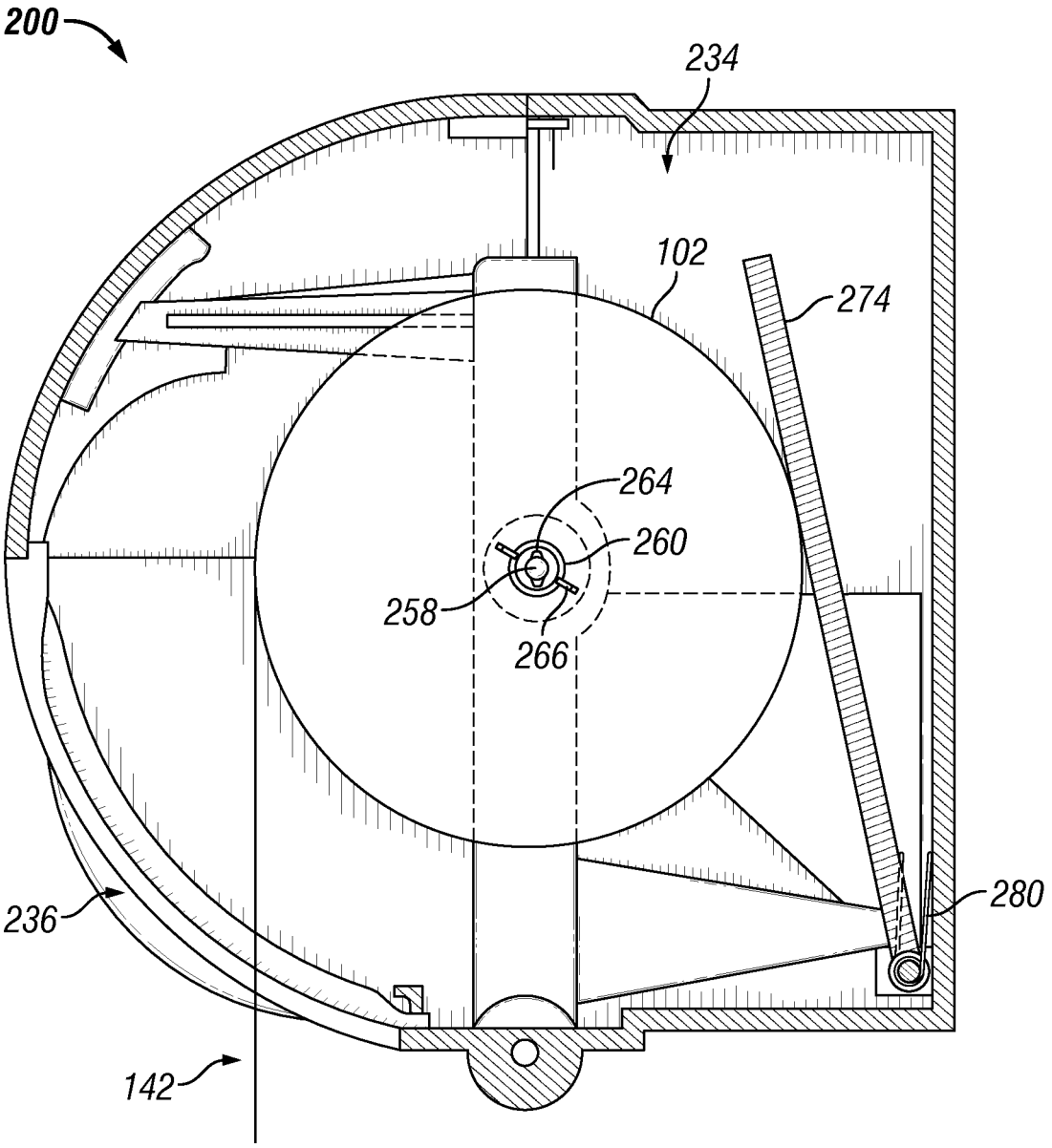
FIG. 2F is a side cross-sectional view of the sheet product dispenser, similar to the view of FIG. 2E, showing the resistance mechanism engaging the roll of sheet product after partial depletion thereof.
Figure 2G:
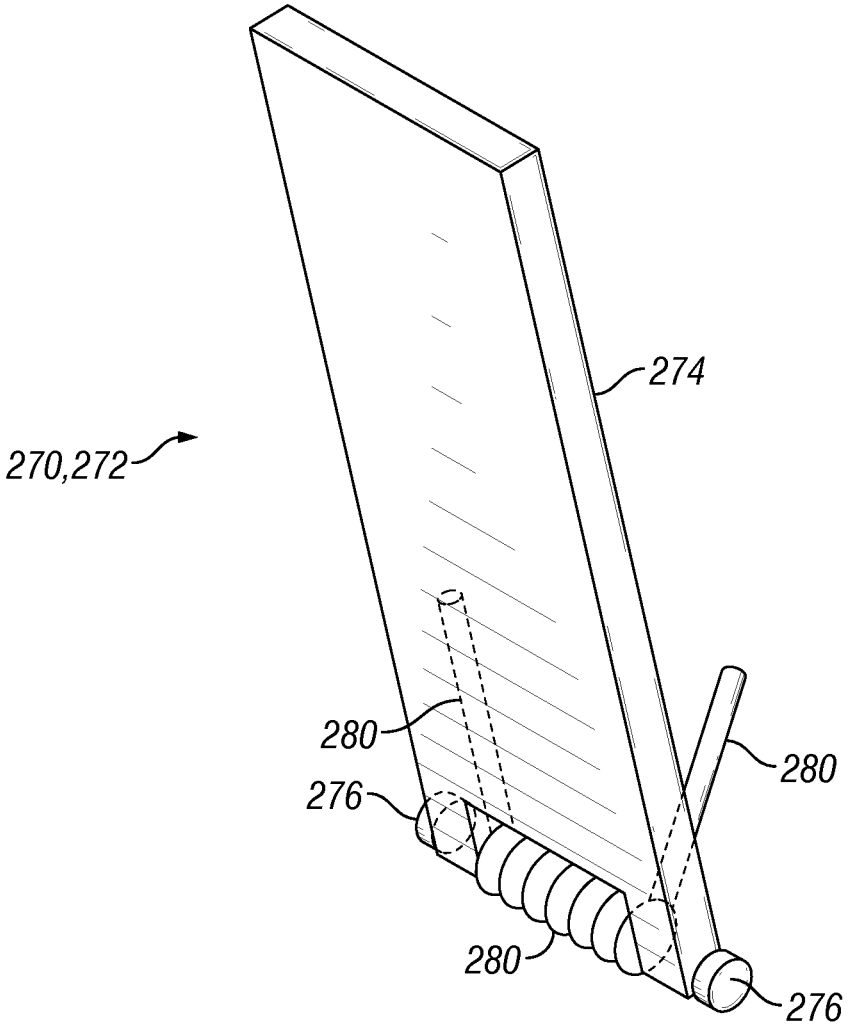
FIG. 2G is a detailed perspective view of the resistance mechanism of the sheet product dispenser of FIG. 2A.
Figure 3A:
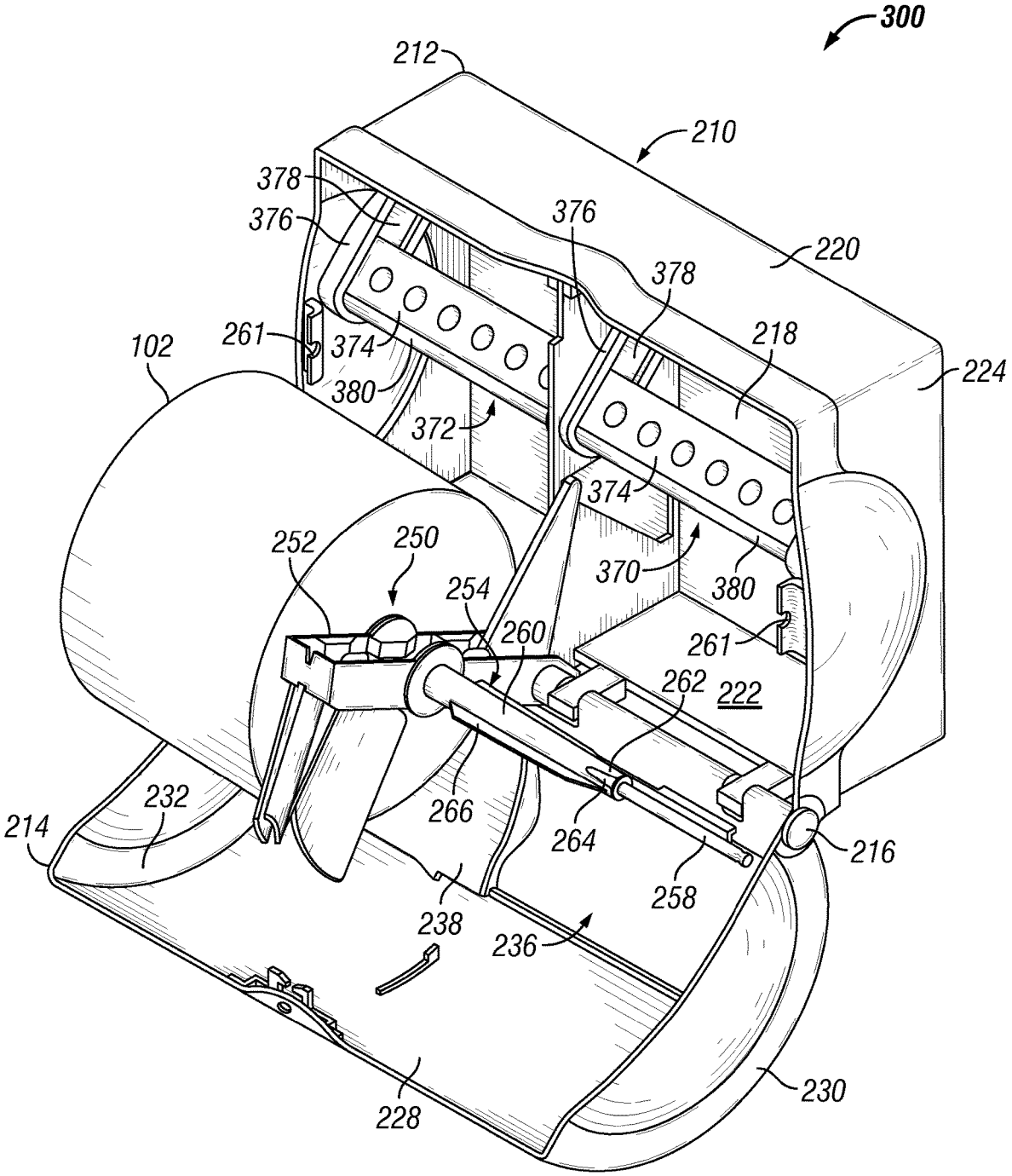
FIG. 3A is a perspective view of a sheet product dispenser in accordance with one or more embodiments of the disclosure, showing a first housing portion of the dispenser in an open position and a roll support mechanism of the dispenser in an extended position for loading rolls of sheet product thereon.
Figure 3B:
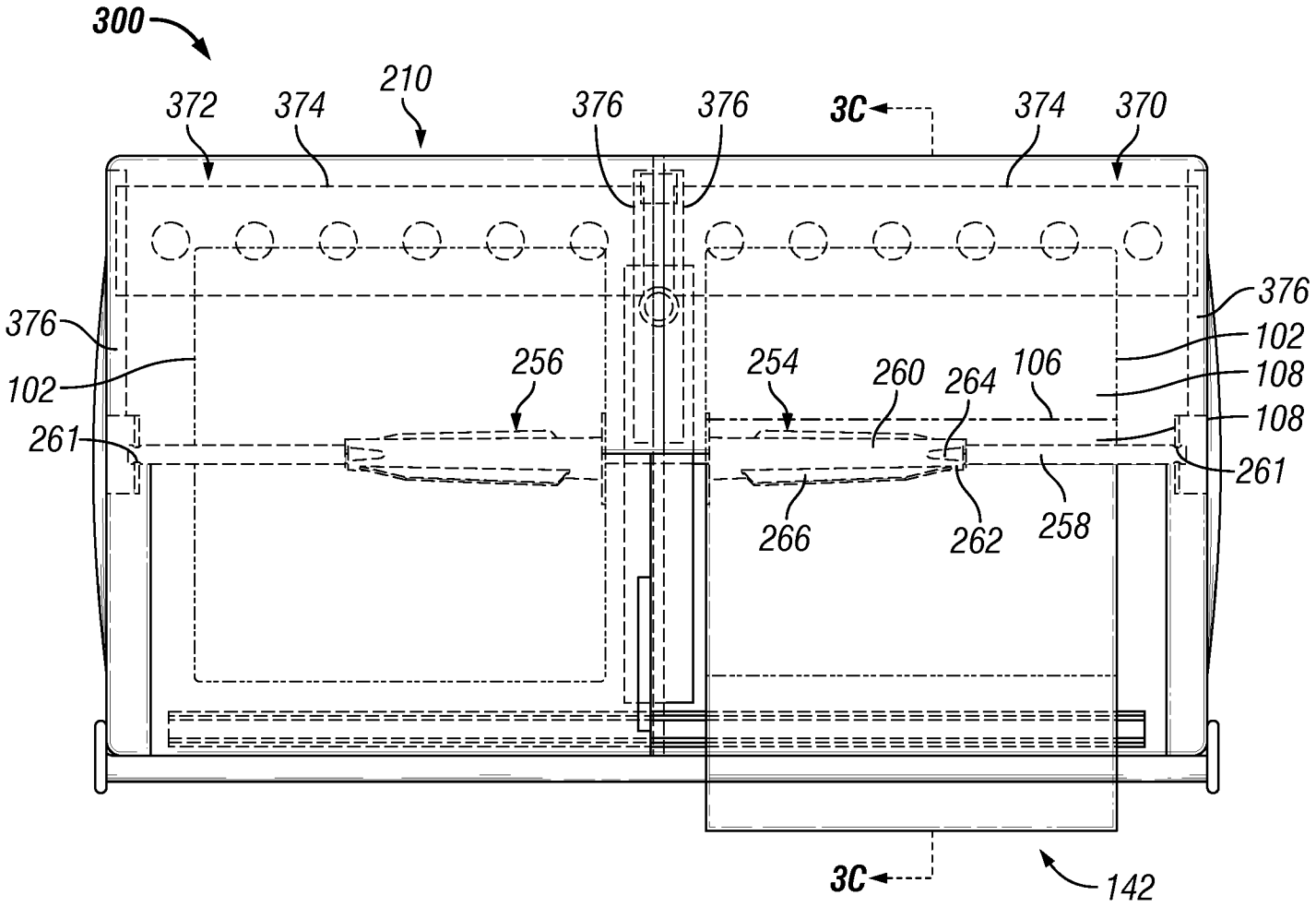
FIG. 3B is a front view of the sheet product dispenser of FIG. 3A, showing the first housing portion in a closed position and the roll support mechanism in a retracted position with two rolls of sheet product loaded thereon for dispensing.
Figure 3C:
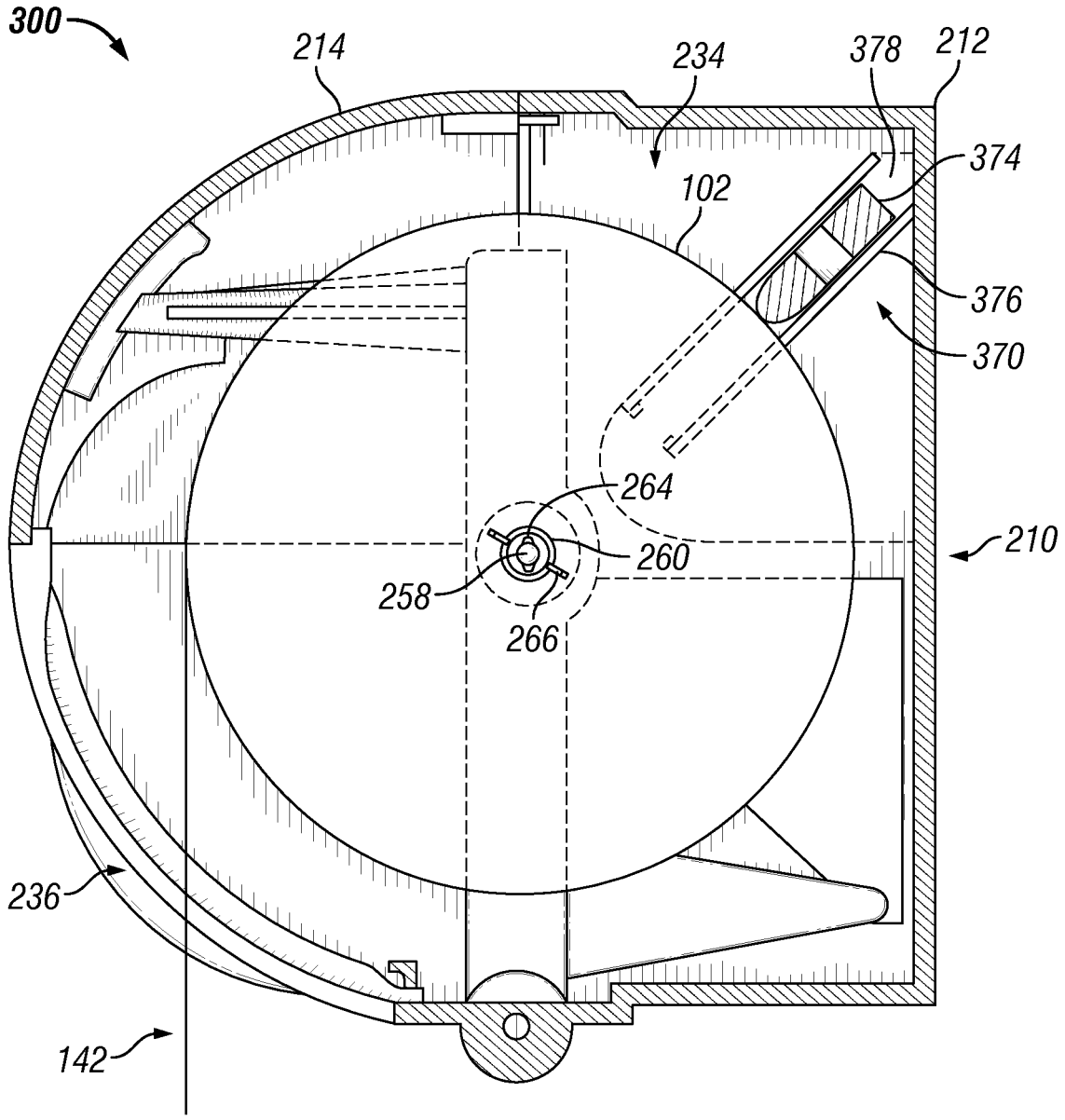
FIG. 3C is a side cross-sectional view of the sheet product dispenser taken along line 3C-3C in FIG. 3B, showing a resistance mechanism of the dispenser engaging a roll of sheet product that is substantially full.
Figure 3D:
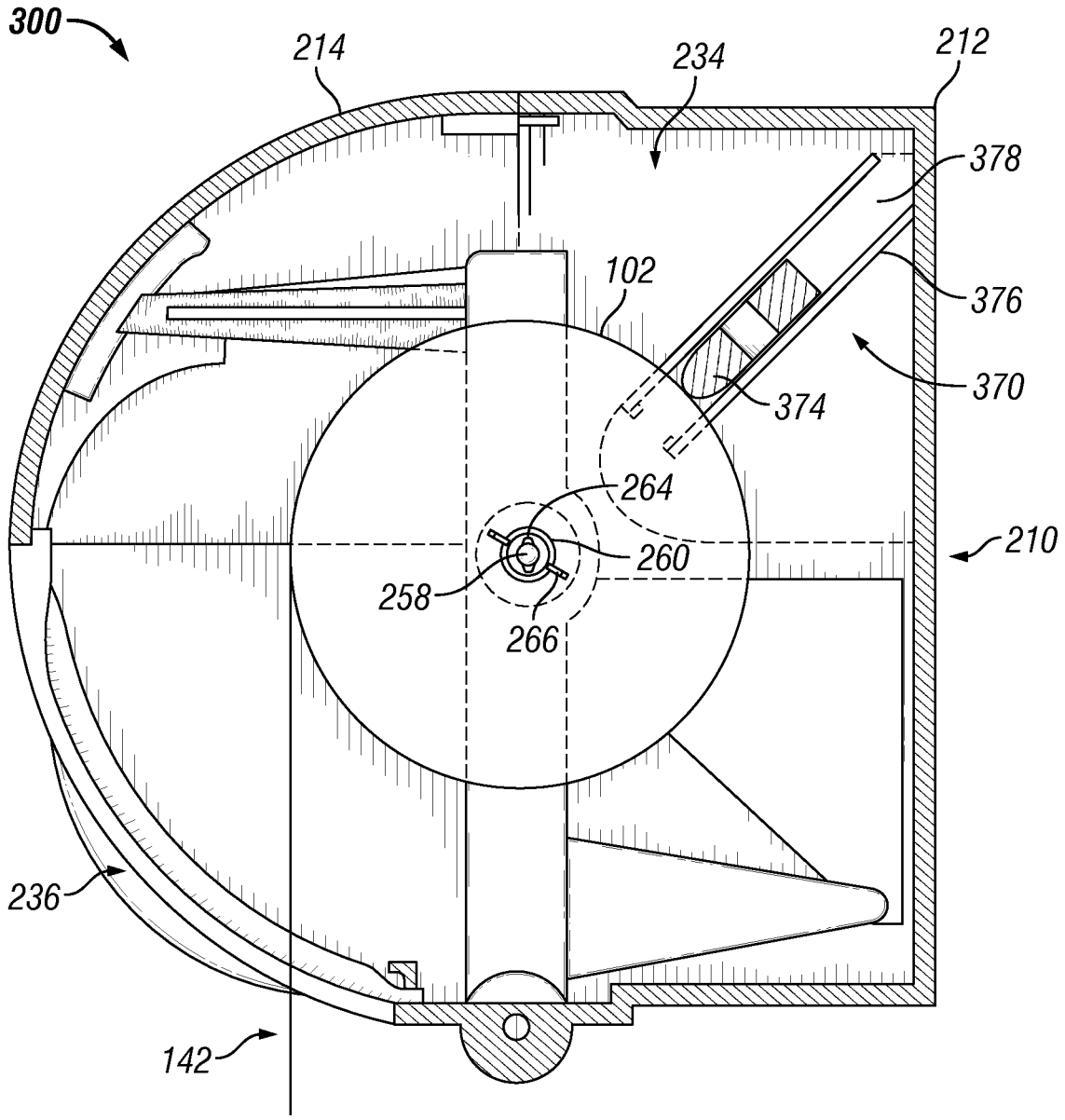
FIG. 3D is a side cross-sectional view of the sheet product dispenser, similar to the view of FIG. 3C, showing the resistance mechanism engaging the roll of sheet product after partial depletion thereof.
Figure 3E:
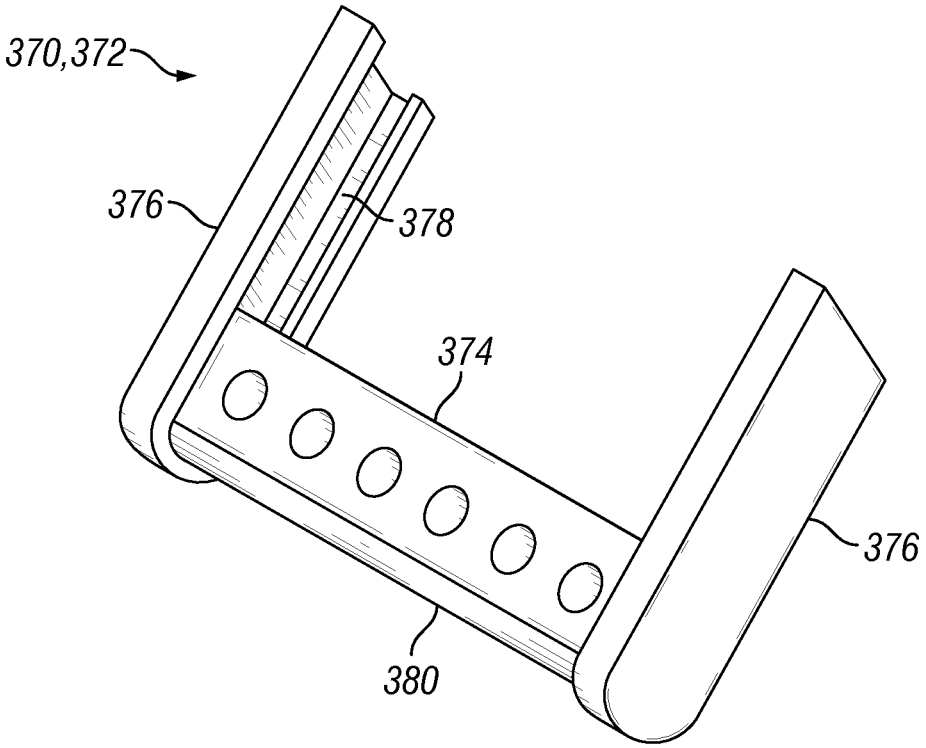
FIG. 3E is a detailed perspective view of the resistance mechanism of the sheet product dispenser of FIG. 3A.

When the second housing portion 214 is in the closed position, the housing 210 may define an interior space 234 configured to receive two rolls 102 of sheet product therein. As is shown, a first roll 102 is disposed within a first side of the interior space 234, and a second roll 102 is disposed within a second side of the interior space 234. The second housing portion 214 may include a dispenser opening 236 defined in the front wall 228, and a cover 238 slidably disposed within the dispenser opening 236. The cover may be configured to move between a first position allowing access to the first roll 102 and blocking access to the second roll 102, as is shown in FIG. 2D, and a second position allowing access to the second roll 102 and blocking access to the first roll 102, as is shown in FIG. 2A. During use of the dispenser 200, a tail portion 142 of the roll 102 being dispensed extends downward through the dispenser opening 236 and out of the housing 210, such that the tail portion 142 may be easily grasped and pulled by a user.

As is shown, the sheet product dispenser 200 also includes a roll support mechanism 250 configured to rotatably support the rolls 102 of sheet product for dispensing therefrom. The roll support mechanism 250 may be pivotally connected to the first housing portion 212 and the second housing portion 214 via the pivot shaft 216 and configured to move between a retracted position for dispensing sheet product, as is shown in FIG. 2D, and an extended position for loading rolls 102 of sheet product, as is shown in FIG. 2B. Specifically, the roll support mechanism 250 may include a support frame 252 that is pivotally connected to the first housing portion 212 and the second housing portion 214 via the pivot shaft 216. The roll support mechanism 250 also may include a first spindle 254 and a second spindle 256 oriented coaxially with one another and extending in opposite directions from the support frame 252. As is shown, the first spindle 254 is configured to support the first roll 102 of sheet product, and the second spindle 256 is configured to support the second roll 102 of sheet product.

Each of the spindles 254, 256 may include a spindle shaft 258 rigidly connected to the support frame 252 and a spindle sleeve 260 rotatably disposed about the spindle shaft 258. When the roll support mechanism 250 is in the retracted position, an outer end of the spindle shaft 258 may engage a mating slot 261 defined in the respective side wall 224, 226, such that the outer end of the spindle shaft 258 is supported thereby. The outer end of the spindle shaft 258 may be rounded or tapered to facilitate insertion of the respective spindle 254, 256 into the central opening 104 of the roll 102 of sheet product supported thereby. The spindle sleeve 260 may include a plurality of flexible fingers 262 extending along a length of the spindle sleeve 260 to an outer end thereof, the flexible fingers 262 defining a plurality of slotted openings 264 therebetween. The fingers 262 may be configured to deflect inwardly and frictionally engage the spindle shaft 258 upon insertion of the respective spindle 254, 256 into the central opening 104 of the roll 102 of sheet product supported thereby. The spindle sleeve 260 also may include a plurality of ribs 266 disposed along the length of the spindle sleeve 260 and extending radially outward therefrom. The ribs 266 may be configured to frictionally engage and securely grip the central opening 104 of the roll 102 of sheet product supported thereby, such that the spindle sleeve 260 rotates with the roll 102 during dispensing of sheet product therefrom.

In addition to the roll support mechanism 250, the sheet product dispenser 200 includes one or more resistance mechanisms configured to engage portions of the rolls 102 of sheet product. As is shown, the sheet product dispenser 200 includes a first resistance mechanism 270 configured to engage a portion of the first roll 102, and a second resistance mechanism 272 configured to engage a portion of the second roll 102. Each of the resistance mechanisms 270, 272 may include an engagement member, such as an arm 274, that is pivotally connected to the first housing portion 212 and configured to frictionally engage an outer surface of the respective roll 102 as the roll 102 rotates during dispensing. As is shown, the arm 274 may be pivotally connected to the back wall 218 via a pair of protrusions 276 of the arm 274 and a mating pair of support members 278 of the back wall 218. Each of the resistance mechanisms 270, 272 also may include a biasing member, such as a torsion spring 280, disposed about the arm 274 and configured to bias the arm 274 away from the back wall 218 and into engagement with the outer surface of the respective roll 102. The biasing member alternatively may be a compression spring, an extension spring, a constant-force coil spring, an elastic element, or any other mechanical element or mechanism for biasing the pressure plate the engagement member.

It will be appreciated that the resistance mechanisms 270, 272 may be provided as a part of the sheet product dispenser 200 upon original manufacture of the dispenser 200 or may be provided as a "retrofit kit" that is added to the dispenser 200 at a point in time after original manufacture of the dispenser 200 (in such applications, the resistance mechanisms 270, 272 may be referred to as "retrofit resistance mechanisms"). It also will be appreciated that the resistance mechanisms 270, 272 may be used, either in original-manufacture applications or retrofit applications, as a part of other sheet product dispensers having configurations different than the sheet product dispenser 200 described herein.

During use of the dispenser 200, a user grasps and applies a pull force to the tail portion 142 of one of the rolls 102 of sheet product sufficient to rotate the roll 102 about the roll support mechanism 250 and unwind a length of sheet product from the roll 102. The roll support mechanism 250 may be configured to provide a pull force resistance opposing the pull force applied by the user. The pull force resistance provided by the roll support mechanism 250 may be a function of an outer diameter of the roll 102 and a rotational resistance generated by the roll support mechanism 250. Based on the configuration of the roll support mechanism 250, the rotational resistance may result from frictional forces generated between one or more rotating components and one or more stationary components of the roll support mechanism 250 and/or between the roll 102 and one or more stationary components of the roll support mechanism 250 as the roll 102 rotates. For example, according to embodiments in which the roll support mechanism 250 includes the spindle shaft 258 and the spindle sleeve 260, the rotational resistance may result, at least partially, from frictional forces generated between the spindle sleeve 260 and the spindle shaft 258 as the spindle sleeve 260 rotates with the roll 102 about the spindle shaft 258. In particular, significant frictional forces may be generated between inner surfaces of the fingers 262 of the spindle sleeve 260 and outer surfaces of the spindle shaft 258. According to various embodiments, the rotational resistance also may result, at least partially, from frictional forces generated between the spindle sleeve 260 and the support frame 252, between the spindle shaft 258 and the roll 102, between the support frame 252 and the roll 102, and/or between the spindle sleeve 260 or the roll 102 and any other feature or component of the roll support mechanism 250 that frictionally engages either the spindle sleeve 260 or the roll 102 as the spindle sleeve 260 rotates with the roll 102 about the spindle shaft 258.

The pull force resistance provided by the roll support mechanism 250 may vary throughout a life of the roll 102 of sheet product, as an outer diameter of the roll 102 decreases. As described above, the pull force resistance provided by the roll support mechanism 250 may be a function of the outer diameter of the roll 102 and the rotational resistance generated by the roll support mechanism 250. As will be understood, based on the configuration of the roll support mechanism 250, the rotational resistance generated by the roll support mechanism 250 may be substantially constant throughout the life of the roll 102. In particular, the frictional forces generated between the spindle sleeve 260 and the spindle shaft 258 may be substantially constant throughout the life of the roll 102 and thus may result in a substantially constant rotational resistance throughout the life of the roll 102. Accordingly, as the outer diameter of the roll 102 decreases, the pull force resistance provided by the roll support mechanism 250 may increase.

During use of the dispenser 200, the respective resistance mechanism 270, 272 also is configured to provide a pull force resistance opposing the pull force applied by the user. The pull force resistance provided by the resistance mechanism 270, 272 may be a function of a frictional resistance generated by the resistance mechanism 270, 272 and the portion of the roll 102 engaged thereby. Based on the configuration of the resistance mechanism 270, 272 the frictional resistance may result from frictional forces generated between the engagement member, such as the arm 274, and the surface of the roll 102 engaged thereby as the roll 102 rotates about the roll support mechanism 250. In particular, significant frictional forces may be generated between the front surface of the arm 274 and the outer surface of the roll 102 as the roll 102 rotates. According to various embodiments, the frictional resistance also may result, at least partially, from frictional forces generated between the roll 102 and any other feature or component of the resistance mechanism 270, 272 that frictionally engages the roll 102 as the roll 102 rotates about the roll support mechanism 250.

The pull force resistance provided by the respective resistance mechanism 270, 272 may vary throughout the life of the roll 102 of sheet product, as the outer diameter of the roll 102 decreases. As described above, the pull force resistance provided by the resistance mechanism 270, 272 may be a function of the frictional resistance generated by the resistance mechanism 270, 272 and the portion of the roll 102 engaged thereby. Based on the configuration of the resistance mechanism 270, 272, the frictional forces generated between the arm 274 and the outer surface of the roll 102 may decrease throughout the life of the roll 102. In particular, the frictional forces generated between the arm 274 and the roll 102 may decrease as an angle of twist (i.e., elastic loading relative to a natural state) of the torsion spring 280 decreases throughout the life of the roll 102. Accordingly, as the outer diameter of the roll 102 decreases, the pull force resistance provided by the resistance mechanism 270, 272 may decrease.

In a preferred embodiment, a sum of the pull force resistance provided by the roll support mechanism 250 and the pull force resistance provided by the respective resistance mechanism 270, 272 is within a range of 36 grams-force and 96 grams-force, a range of 46 grams-force and 86 grams-force, or a range of 56 grams-force and 76 grams-force, throughout the life of the roll 102 or throughout a majority of the life of the roll 102. In this manner, a total pull force resistance provided by the dispenser 200 (and thus experienced by the user when applying the pull force to the tail portion 142 of the roll 102) is, in a preferred embodiment, within a range of 36 grams-force and 96 grams-force, a range of 46 grams-force and 86 grams-force, or a range of 56 grams-force and 76 grams-force, throughout the life of the roll 102 or throughout a majority of the life of the roll 102.

In some embodiments, the pull force resistance provided by the roll support mechanism 250 is relatively small and thus constitutes a relatively small portion of the total pull force resistance provided by the dispenser 200. In other embodiments, the pull force resistance provided by the roll support mechanism 250 is relatively large and thus constitutes a relatively large portion of the total pull force resistance provided by the dispenser 200. In some embodiments, the resistance mechanism 270, 272 is omitted from the dispenser 200, and thus the pull force resistance provided by the roll support mechanism 250 constitutes the entirety of the total pull force resistance provided by the dispenser 200. In some embodiments, the pull force resistance provided by the roll support mechanism 250 is within a range of 5 grams-force and 35 grams-force throughout the life of the roll 102 or throughout a majority of the life of the roll 102. In some embodiments, the pull force resistance provided by the roll support mechanism 250 varies from between 5 grams-force and 25 grams-force at the beginning of the life of the roll 102 (i.e., when the roll 102 is full) to between 15 grams-force and 35 grams-force at the end of the life of the roll (i.e., when the roll 102 is completely depleted). The materials, surface treatments, dimensions, and mating contact areas of the spindle sleeve 260, the spindle shaft 258, and any other feature or component of the roll support mechanism 250 that frictionally engages either the spindle sleeve 260 or the roll 102 may be selected such that the pull force resistance provided by the roll support mechanism 250 is within a desired range throughout the life of the roll 102 or throughout a majority of the life of the roll 102.

In some embodiments, the pull force resistance provided by the respective resistance mechanism 270, 272 is relatively small and thus constitutes a relatively small portion of the total pull force resistance provided by the dispenser 200. In other embodiments, the pull force resistance provided by the resistance mechanism 270, 272 is relatively large and thus constitutes a relatively large portion of the total pull force resistance provided by the dispenser 200. In some embodiments, the roll support mechanism 250 is omitted from the dispenser 200, and thus the pull force resistance provided by the resistance mechanism 270, 272 constitutes the entirety of the total pull force resistance provided by the dispenser 200. In some embodiments, the pull force resistance provided by the resistance mechanism 270, 272 is within a range of 35 grams-force and 90 grams-force throughout the life of the roll 102 or throughout a majority of the life of the roll 102. In some embodiments, the pull force resistance provided by the resistance mechanism 270, 272 varies from between 75 grams-force and 90 grams-force at the beginning of the life of the roll 102 to between 35 grams-force and 50 grams-force at the end of the life of the roll. The spring constant (i.e., stiffness) of the torsion spring 280 and the materials, surface treatments, dimensions, and mating contact areas of the arm 274 and any other feature or component of the resistance mechanism 270, 272 that frictionally engages the roll 102 may be selected such that the pull force resistance provided by the resistance mechanism 270, 272 is within a desired range throughout the life of the roll 102 or throughout a majority of the life of the roll 102.

FIGS. 3A-3E show a sheet product dispenser 300 according to one or more embodiments of the disclosure. The dispenser 300 is configured to allow a user to obtain a user-determined length of sheet product from a roll 102 of sheet product supported by the dispenser 300. As is shown, the dispenser 300 may include various components and features corresponding to those described above with respect to the dispenser 200 and indicated by the same reference numbers, which components and features may be formed, oriented, and configured to function in the manner described above. For example, the sheet product dispenser 300 may include the housing 210 configured to receive two rolls 102 of sheet product therein, and the roll support mechanism 250 configured to rotatably support the rolls 102 for dispensing therefrom. Certain structural and functional differences between the dispenser 300 and the dispenser 200 are described as follows. Different components and features of the dispenser 300 are indicated by different reference numbers.

In addition to the roll support mechanism 250, the sheet product dispenser 300 includes one or more resistance mechanisms configured to engage portions of the rolls 102 of sheet product. As is shown, the sheet product dispenser 300 includes a first resistance mechanism 370 configured to engage a portion of the first roll 102, and a second resistance mechanism 372 configured to engage a portion of the second roll 102. Each of the resistance mechanisms 370, 372 may include an engagement member, such as a load member 374, and a pair of guide members 376. The guide members 376 may be rigidly connected to the first housing portion 212, as is shown. Ends of the load member 374 may be disposed within and slidably engage channels 378 defined in the guide members 376. In this manner, the load member 374 may be configured to slide along a path defined by the channels 378 due to the force of gravity and to frictionally engage an outer surface of the respective roll 102 as the roll 102 rotates during dispensing. As is shown, the path along which the load member 374 slides is a linear path extending directly toward the longitudinal axis of the roll 102. In some embodiments, the linear path is oriented approximately 45 degrees from vertical, and thus the load member 374 has an angle of incidence of approximately 45 degrees from vertical, as is shown. In various other embodiments, the linear path is oriented at other angles, such as between vertical and 80 degrees from vertical, and the load member 374 has a corresponding angle of incidence. As will be understood, the angle of incidence of the load member 374 may affect the normal force acting on the load member 374 and thus the frictional forces generated between the load member 374 and the roll 102. The path along which the load member 374 slides alternatively may be a curved path extending toward the longitudinal axis of the roll 102. As will be understood, the curved path may cause the angle of incidence of the load member 374 to vary as the load member 374 slides along the curved path, and thus the normal force acting on the load member 374 and the frictional forces generated between the load member 374 and the roll 102 may vary, as may be desired in some embodiments. The load member 374 may include a contact portion 380 configured to frictionally engage the outer surface of the roll 102. As is shown, the contact portion 380 may have a rounded surface.

It will be appreciated that the resistance mechanisms 370, 372 may be provided as a part of the sheet product dispenser 300 upon original manufacture of the dispenser 300 or may be provided as a "retrofit kit" that is added to the dispenser 300 at a point in time after original manufacture of the dispenser 300 (in such applications, the resistance mechanisms 370, 372 may be referred to as "retrofit resistance mechanisms"). It also will be appreciated that the resistance mechanisms 370, 372 may be used, either in original-manufacture applications or retrofit applications, as a part of other sheet product dispensers having configurations different than the sheet product dispenser 300 described herein.

During use of the dispenser 300, a user grasps and applies a pull force to the tail portion 142 of one of the rolls 102 of sheet product sufficient to rotate the roll 102 about the roll support mechanism 250 and unwind a length of sheet product from the roll 102. As described above, the roll support mechanism 250 may be configured to provide a pull force resistance opposing the pull force applied by the user. The respective resistance mechanism 370, 372 also may be configured to provide a pull force resistance opposing the pull force applied by the user. The pull force resistance provided by the resistance mechanism 370, 372 may be a function of a frictional resistance generated by the resistance mechanism 370, 372 and the portion of the roll 102 engaged thereby. Based on the configuration of the resistance mechanism 370, 372, the frictional resistance may result from frictional forces generated between the engagement member, such as the load member 374, and surface of the roll 102 engaged thereby as the roll 102 rotates about the roll support mechanism 250. In particular, significant frictional forces may be generated between the contact portion 380 of the load member 374 and the outer surface of the roll 102 as the roll 102 rotates. According to various embodiments, the frictional resistance also may result, at least partially, from frictional forces generated between the roll 102 and any other feature or component of the resistance mechanism 370, 372 that frictionally engages the roll 102 as the roll 102 rotates about the roll support mechanism 250.

As described above, the pull force resistance provided by the roll support mechanism 250 may vary throughout a life of the roll 102 of sheet product, as an outer diameter of the roll 102 decreases. Specifically, as the outer diameter of the roll 102 decreases, the pull force resistance provided by the roll support mechanism 250 may increase. The pull force resistance provided by the respective resistance mechanism 370, 372 may be substantially constant or may vary throughout the life of the roll 102. As described above, the pull force resistance provided by the resistance mechanism 370, 372 may be a function of the frictional resistance generated by the resistance mechanism 370, 372 and the portion of the roll 102 engaged thereby. In some embodiments, such as those in which the load member 374 slides along a linear path, the frictional forces generated between the load member 374 and the outer surface of the roll 102 engaged thereby are substantially constant throughout the life of the roll 102. Accordingly, as the outer diameter of the roll 102 decreases, the pull force resistance provided by the resistance mechanism 370, 372 may be substantially constant. In other embodiments, such as those in which the load member 374 slides along a curved path, the frictional forces generated between the load member 374 and the outer surface of the roll 102 engaged thereby increase or decrease throughout the life of the roll 102. Accordingly, as the outer diameter of the roll 102 decreases, the pull force resistance provided by the resistance mechanism 370, 372 may increase or decrease.

In a preferred embodiment, a sum of the pull force resistance provided by the roll support mechanism 250 and the pull force resistance provided by the respective resistance mechanism 370, 372 is within a range of 36 grams-force and 96 grams-force, a range of 46 grams-force and 86 grams-force, or a range of 56 grams-force and 76 grams-force, throughout the life of the roll 102 or throughout a majority of the life of the roll 102. In this manner, a total pull force resistance provided by the dispenser 300 (and thus experienced by the user when applying the pull force to the tail portion 142 of the roll 102) is, in a preferred embodiment, within a range of 36 grams-force and 96 grams-force, a range of 46 grams-force and 86 grams-force, or a range of 56 grams-force and 76 grams-force, throughout the life of the roll 102 or throughout a majority of the life of the roll 102.

In some embodiments, the pull force resistance provided by the roll support mechanism 250 is relatively small and thus constitutes a relatively small portion of the total pull force resistance provided by the dispenser 300. In other embodiments, the pull force resistance provided by the roll support mechanism 250 is relatively large and thus constitutes a relatively large portion of the total pull force resistance provided by the dispenser 300. In some embodiments, the resistance mechanism 370, 372 is omitted from the dispenser 300, and thus the pull force resistance provided by the roll support mechanism 250 constitutes the entirety of the total pull force resistance provided by the dispenser 300. In some embodiments, the pull force resistance provided by the roll support mechanism 250 is within a range of 5 grams-force and 35 grams-force throughout the life of the roll 102 or throughout a majority of the life of the roll 102. In some embodiments, the pull force resistance provided by the roll support mechanism 250 varies from between 5 grams-force and 25 grams-force at the beginning of the life of the roll 102 (i.e., when the roll 102 is full) to between 15 grams-force and 35 grams-force at the end of the life of the roll (i.e., when the roll 102 is completely depleted). The materials, surface treatments, dimensions, and mating contact areas of the spindle sleeve 260, the spindle shaft 258, and any other feature or component of the roll support mechanism 250 that frictionally engages either the spindle sleeve 260 or the roll 102 may be selected such that the pull force resistance provided by the roll support mechanism 250 is within a desired range throughout the life of the roll 102 or throughout a majority of the life of the roll 102.

In some embodiments, the pull force resistance provided by the respective resistance mechanism 370, 372 is relatively small and thus constitutes a relatively small portion of the total pull force resistance provided by the dispenser 300. In other embodiments, the pull force resistance provided by the resistance mechanism 370, 372 is relatively large and thus constitutes a relatively large portion of the total pull force resistance provided by the dispenser 300. In some embodiments, the roll support mechanism 250 is omitted from the dispenser 300, and thus the pull force resistance provided by the resistance mechanism 370, 372 constitutes the entirety of the total pull force resistance provided by the dispenser 300. In some embodiments, the pull force resistance provided by the resistance mechanism 370, 372 is within a range of 35 grams-force and 90 grams-force throughout the life of the roll 102 or throughout a majority of the life of the roll 102. In some embodiments, the pull force resistance provided by the resistance mechanism 370, 272 varies from between 75 grams-force and 90 grams-force at the beginning of the life of the roll 102 to between 35 grams-force and 50 grams-force at the end of the life of the roll. The shape of the path along which the load member 374 slides, the angle of incidence of the load member 374, and the materials, surface treatments, mass, dimensions, and mating contact areas of the load member 374 and any other feature or component of the resistance mechanism 370, 372 that frictionally engages the roll 102 may be selected such that the pull force resistance provided by the resistance mechanism 370, 372 is within a desired range throughout the life of the roll 102 or throughout a majority of the life of the roll 102.

FIGS. 4A-4E show a resistance mechanism 400 according to one or more embodiments of the disclosure. The resistance mechanism 400 may be used as a part of a sheet product dispenser that is configured to allow a user to obtain a user-determined length of sheet product from a roll of sheet product supported by the dispenser. For example, the resistance mechanism 400 may be used as a part of the sheet product dispenser 100 described above (in other words, the resistance mechanism 170 described above may be the resistance mechanism 400) or any other sheet product dispenser. In certain applications, the resistance mechanism 400 may be provided as a part of a sheet product dispenser upon original manufacture of the dispenser. In other applications, the resistance mechanism 400 may be provided as a "retrofit kit" that is added to a sheet product dispenser at a point in time after original manufacture of the dispenser (in such applications, the resistance mechanism 400 may be referred to as a "retrofit resistance mechanism"). For example, the resistance mechanism 400 may be added to a sheet product dispenser that is already in operation in a particular working environment. In this manner, the sheet product dispenser may be retrofitted to include the resistance mechanism 400.

As is shown, the resistance mechanism 400 may be configured to engage a portion of a roll 102 of sheet product that is rotatably supported by a sheet product dispenser. The resistance mechanism 400 may include an arm 404 (which also may be referred to herein as a "paddle" or an "engagement member") that is configured to frictionally engage a portion of the roll 102 as the roll 102 rotates during dispensing. In some embodiments, as is shown, the arm 404 is configured to frictionally engage an outer surface of the roll 102. In other embodiments, the arm 404 is configured to frictionally engage an end surface of the roll 102. The resistance mechanism 400 also may include a spring 410 (which also may be referred to herein as a "biasing member") that is configured to bias the arm 404 into engagement with the desired surface of the roll 102.

The arm 404 may be formed as an elongated member having a generally plate-like shape, although other shapes and configurations of the arm 404 may be used. As is shown, the arm 404 may include a base end 412 (which also may be referred to herein as a "proximal end"), a free end 414 (which also may be referred to herein as a "distal end"), a front side 416 (which also may be referred to herein as an "engagement side"), and a back side 418 (which also may be referred to herein as a "support side"). As described below, the arm 404 may be configured to be pivotally connected to a portion of a sheet product dispenser, such as a housing thereof, at or near the base end 412 of the arm 404, and the free end 414 may be configured to move freely as the arm 404 pivots relative to the portion of the sheet product dispenser. A portion of the front side 416 of the arm 404 may be configured to engage the desired portion of the roll 102 of sheet product, and a portion of the back side 418 may be configured to engage a portion of the spring 410.

The front side 416 of the arm 404 may include an engagement surface 420 configured to engage the desired surface of the roll 102. In some embodiments, as is shown, the engagement surface 420 is a smooth surface. In other embodiments, the engagement surface 420 is a textured surface, which may include one or more protrusions, ribs, knurled regions, or other textured features. In some embodiments, as is shown, the engagement surface 420 is a flat surface. In other embodiments, the engagement surface 420 is a contoured surface, which may include one or more curved, angled, or otherwise contoured regions. It will be understood that the texture and shape of the engagement surface 420 may be selected to result in a desired coefficient of friction between the engagement surface 420 and the surface of the roll 102 engaged thereby.

In some embodiments, as is shown, the spring 410 of the resistance mechanism 400 is a helical torsion spring including a coiled portion 422, a first spring arm 424 positioned at a first end of the coiled portion 422, and a second spring arm 426 positioned at a second end of the coiled portion 422. In other embodiments, the spring 410 may be a compression spring, an extension spring, a constant-force coil spring, or an elastic element configured to bias the arm 404 into engagement with the desired surface of the roll 102.

The arm 404 of the resistance mechanism 400 may include one or more protrusions 430 (which also may be referred to herein as "pins") positioned at or near the base end 412 of the arm 404. For example, the arm 404 may include a pair of the protrusions 430 positioned at or near the base end 412 and opposite one another. The protrusions 430 may have a cylindrical shape, as is shown, although other shapes of the protrusions 430 may be used. The protrusions 430 may be configured to pivotally connect the arm 404 to a portion of a sheet product dispenser, such as a housing thereof, and also may be configured to connect the spring 410 to the arm 404. As is shown, each protrusion 430 may include an inner portion 432 (which also may be referred to herein as a "first portion") and an outer portion 434 (which also may be referred to herein as a "second portion"). The inner portions 432 of the protrusions 430 may be configured to be received at least partially within the coiled portion 422 of the spring 410. In this manner, the spring 410 may be securely attached to the arm 404. The outer portions 434 of the protrusions 430 may be configured to be received at least partially within support members of a sheet product dispenser, as described below. The connections between the protrusions 430 and the support members may allow the arm 404 to pivot thereabout.

The arm 404 of the resistance mechanism 400 may include one or more tabs 440 (which also may be referred to herein as "limiting tabs") positioned at or near the base end 412 of the arm 404. For example, the arm 404 may include a pair of the tabs 440 positioned at or near the base end 412 and opposite one another. The tabs 440 may be configured to limit pivotal movement of the arm 404 relative to a portion of a sheet product dispenser, such as a housing thereof. As is shown, each tab 440 may include a back side 442 (which also may be referred to herein as an "engagement side"). The back sides 442 each may include an engagement surface 444 configured to engage a portion of a sheet product dispenser to limit pivotal movement of the arm 404, as described below. In some embodiments, as is shown, the engagement surfaces 444 of the tabs 440 are flat surfaces and are angled (i.e., not parallel) relative to the engagement surface 420 of the arm 404.

The arm 404 of the resistance mechanism 400 may include a plurality of ribs 448 (which also may be referred to herein as "stiffening ribs") configured to provide structural support and resist bending of the arm 404 when the arm 404 is biased into engagement with the roll 102. In particular, as is shown, the arm 404 may include one or more ribs 448 extending parallel to a longitudinal axis A1 of the arm 404 (i.e., extending along a length of the arm 404), one or more ribs 448 extending parallel to a lateral axis A2 of the arm 404 (i.e., extending along a width of the arm 404), and one or more ribs 448 extending at a non-perpendicular angle relative to the longitudinal axis A1 and the lateral axis A2 of the arm 404. The ribs 448 may be connected to one another and arranged in a web configured to distribute forces applied to the arm 404 when the arm 404 is biased into engagement with the roll 102. The web of the ribs 448 may be positioned closer to the base end 412 than the free end 414 of the arm 404. In some embodiments, as is shown, the ribs 448 are positioned along the back side 418 of the arm 404. In other embodiments, the ribs 448 are positioned along the front side 416 of the arm 404.

As is shown, the arm 404 may include a recess 452 configured to receive a portion of the spring 410 therein. In particular, the recess 452 may be configured to receive at least a portion of the first spring arm 424 therein. In this manner, the first spring arm 424 may be securely oriented with respect to the arm 404, in particular with respect to the protrusions 430, to facilitate biasing the arm 404 into engagement with the roll 102. In some embodiments, as is shown, the recess 452 is a groove positioned along the back side 418 of the arm 404, although other shapes and positions of the recess 452 may be used.

The arm 404 also may include a number of features configured to facilitate installation of the resistance mechanism 400 in or to a sheet product dispenser. In particular, the arm 404 may include a hook 454 (which also may be referred to herein as a "retention hook"), a first aperture 456 (which also may be referred to herein as an "insertion aperture"), and a second aperture 458 (which also may be referred to herein as a "release aperture") configured to facilitate elastic loading of the spring 410 before connecting the arm 404 to a desired portion of the sheet product dispenser, and to facilitate releasing the spring 410 after connecting the arm 404 to the desired portion of the sheet product dispenser. As is shown, the hook 454 may be positioned along the back side 418 of the arm 404 and may extend toward the longitudinal axis A1 thereof. The first aperture 456 may be positioned adjacent the hook 454 between the hook 454 and the longitudinal axis A1 of the arm 404 and may extend through the arm 404 from the back side 418 to the front side 416 thereof. The second aperture 458 may be positioned between the hook 454 and the base end 412 of the arm 404 and may extend through the arm 404 from the back side 418 to the front side 416 thereof.

Figure 4A:
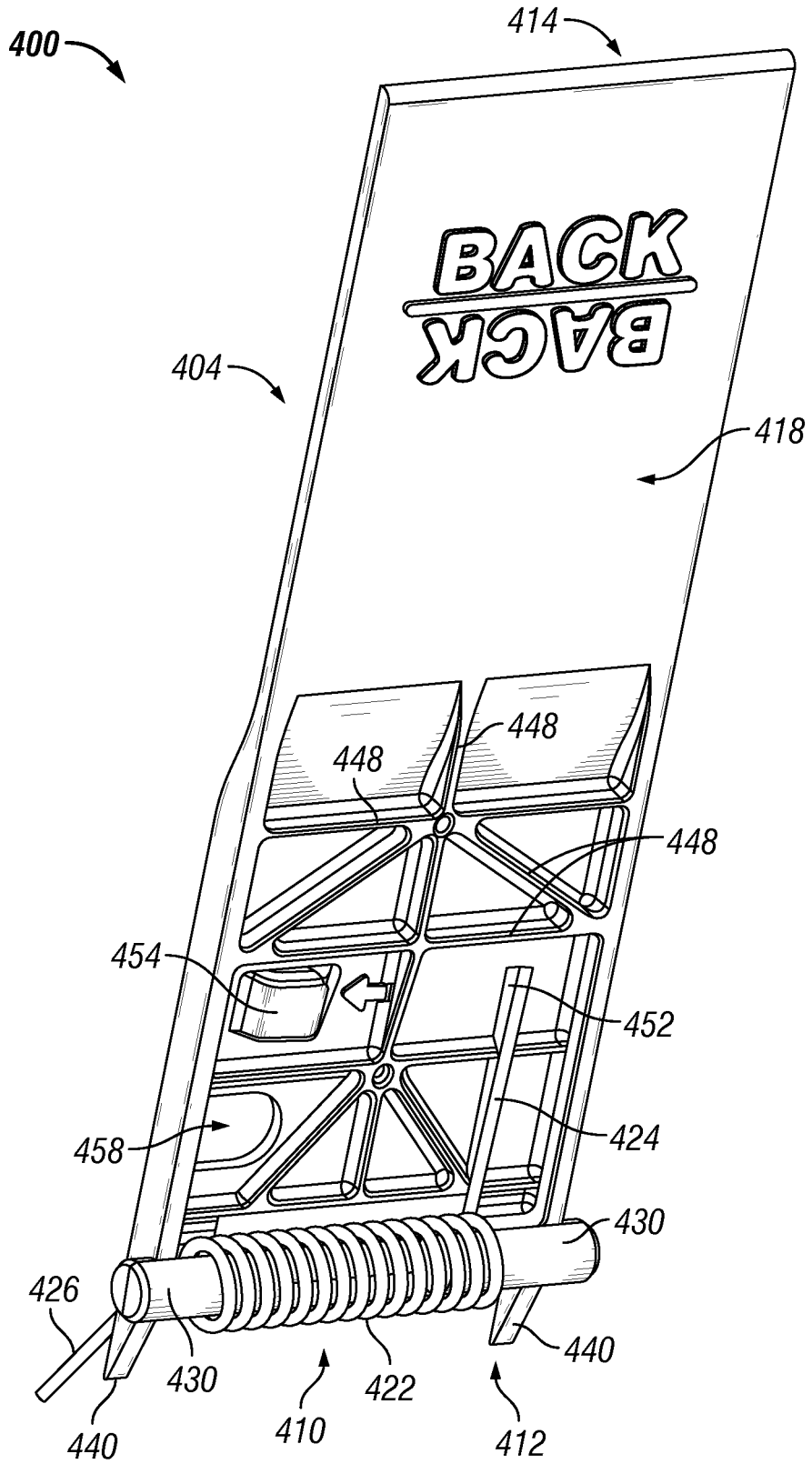
FIG. 4A is a perspective view of a resistance mechanism in accordance with one or more embodiments of the disclosure.
Figure 4B:
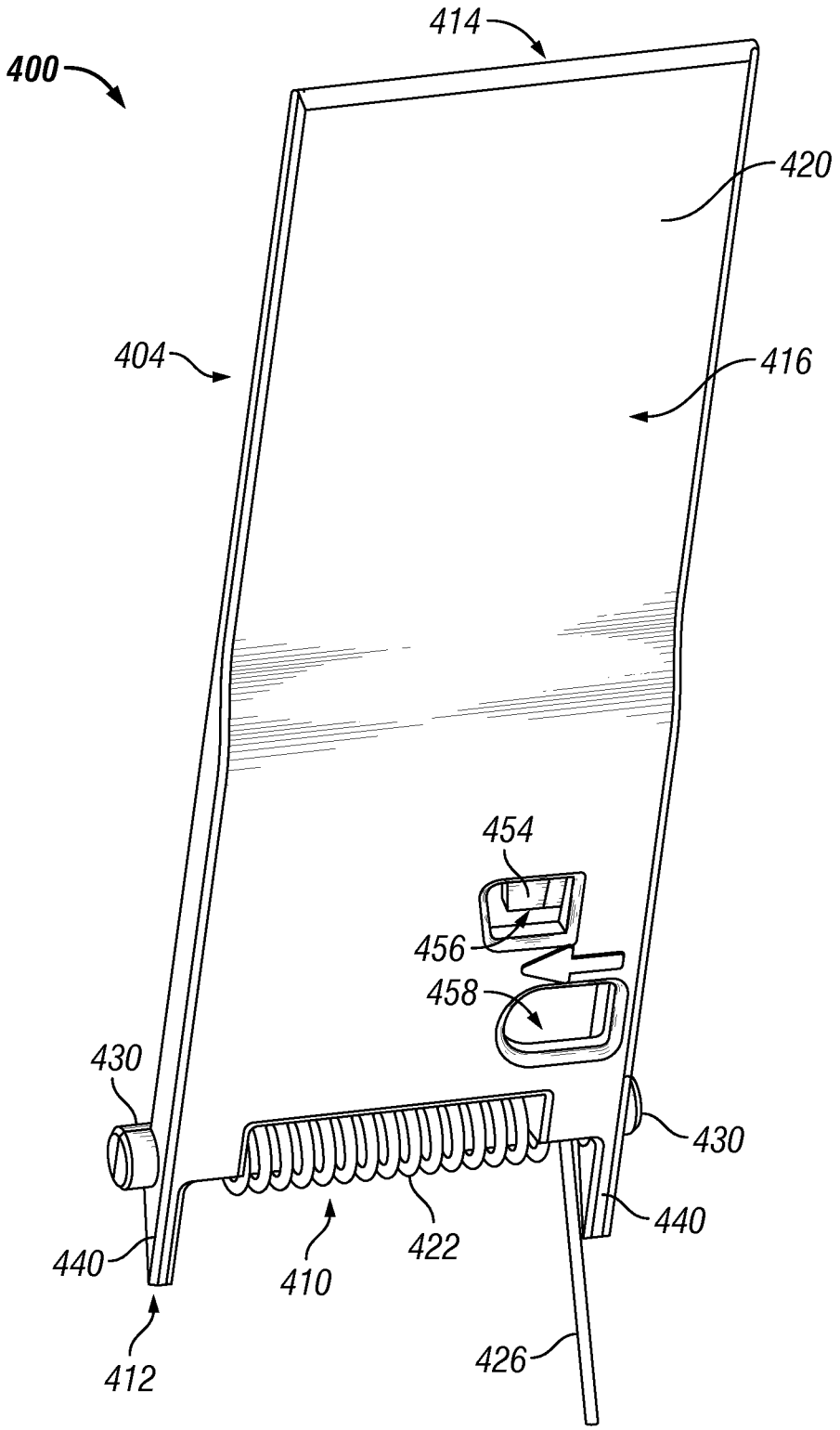
FIG. 4B is a perspective view of the resistance mechanism of FIG. 4A.
Figure 4C:
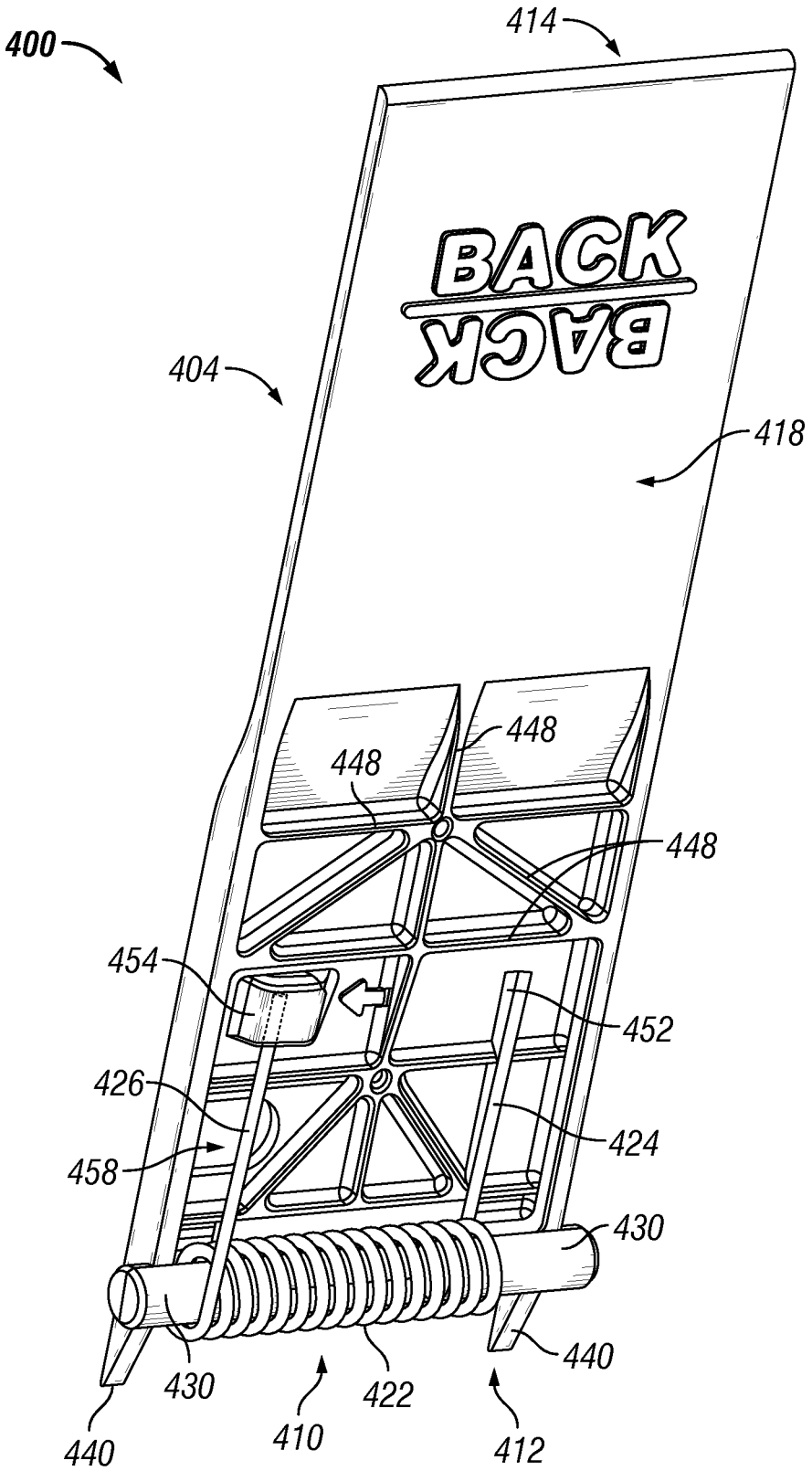
FIG. 4C is a perspective view of the resistance mechanism of FIG. 4A.
Figure 4D:
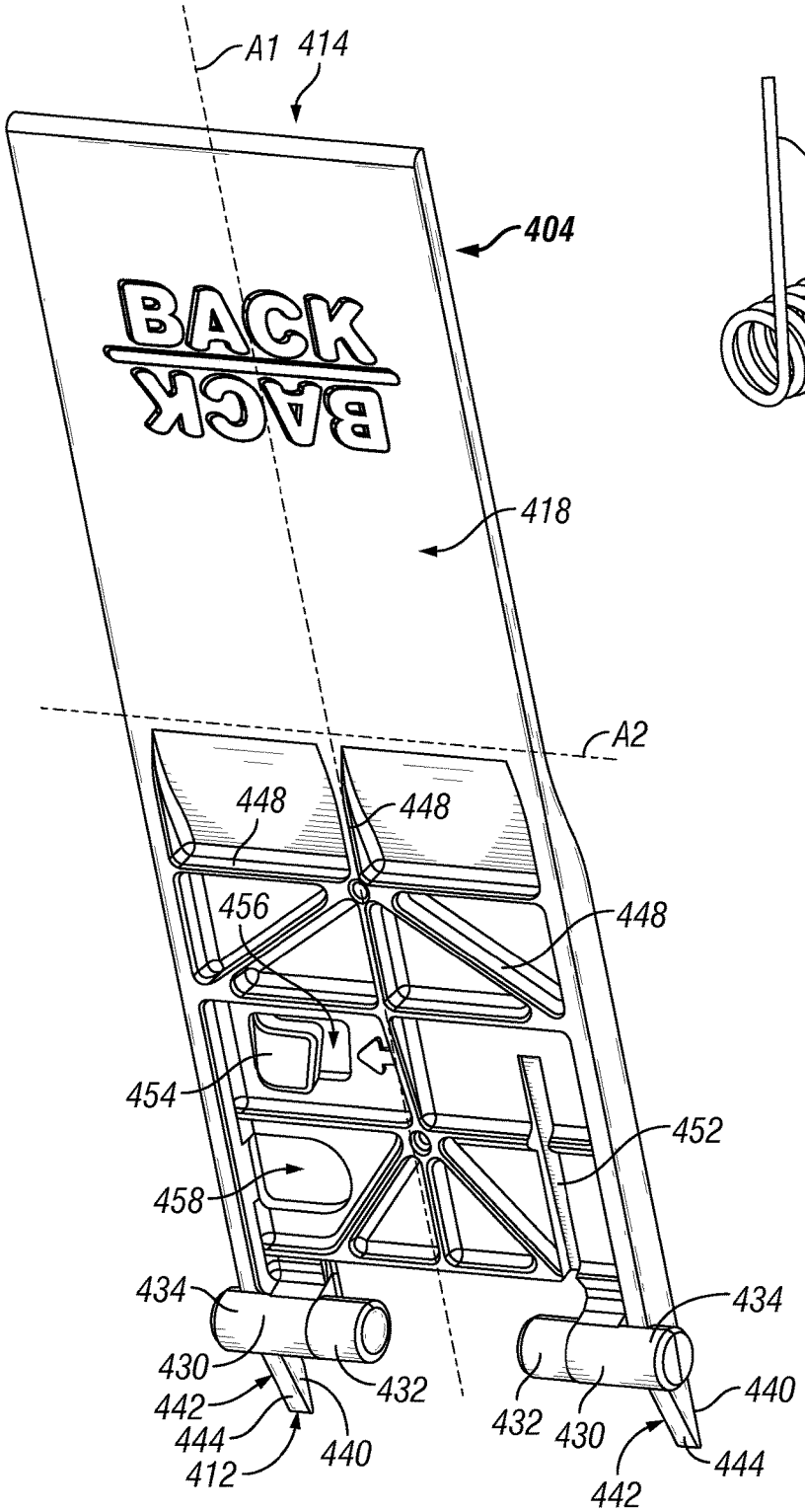
FIG. 4D is a detailed perspective view of an arm of the resistance mechanism of FIG. 4A.
Figure 4E:
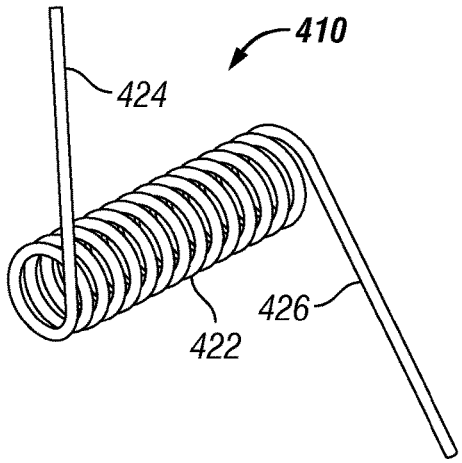
FIG. 4E is a detailed perspective view of a spring of the resistance mechanism of FIG. 4A.

During installation of the resistance mechanism 400, the spring 410 may be elastically loaded by moving the second spring arm 426 from a first position (which also may be referred to herein as an "attachment position"), as is shown in FIGS. 4A and 4B, to a second position (which also may be referred to herein as an "installation position"), as is shown in FIG. 4C. In particular, the second spring arm 426 may be rotated about the protrusions 430 and moved laterally around and into the hook 454. As is shown, the hook 454 may be configured to receive a portion of the second spring arm 426 therein, thereby retaining the second spring arm 426 in the second position. The first aperture 456 may be configured to allow the free end of the second spring arm 426 to pass therethrough as the second spring arm 426 is moved around and into the hook 454, thereby facilitating insertion of the second spring arm 426 into the hook 454. With the second spring arm 426 in the second position, the arm 404 may be connected to the desired portion of the sheet product dispenser via the protrusions 430, without the second spring arm 426 interfering with such connection. After connecting the arm 404 to the desired portion of the sheet product dispenser, the second spring arm 426 may be released from the hook 454. In particular, an elongated tool, such as a pin, a rod, or a screwdriver, may be inserted through the second aperture 458 from the front side 416 of the arm 404 and used to engage and move the second spring arm 426 laterally toward the longitudinal axis A1 of the arm 404 and out of the hook 454. Upon releasing the second spring arm 426 from the hook 454, the second spring arm 426 may engage an adjacent portion of the sheet product dispenser such that the spring 410 biases the arm 404 away from the adjacent portion of the sheet product dispenser.

Figure 4F:
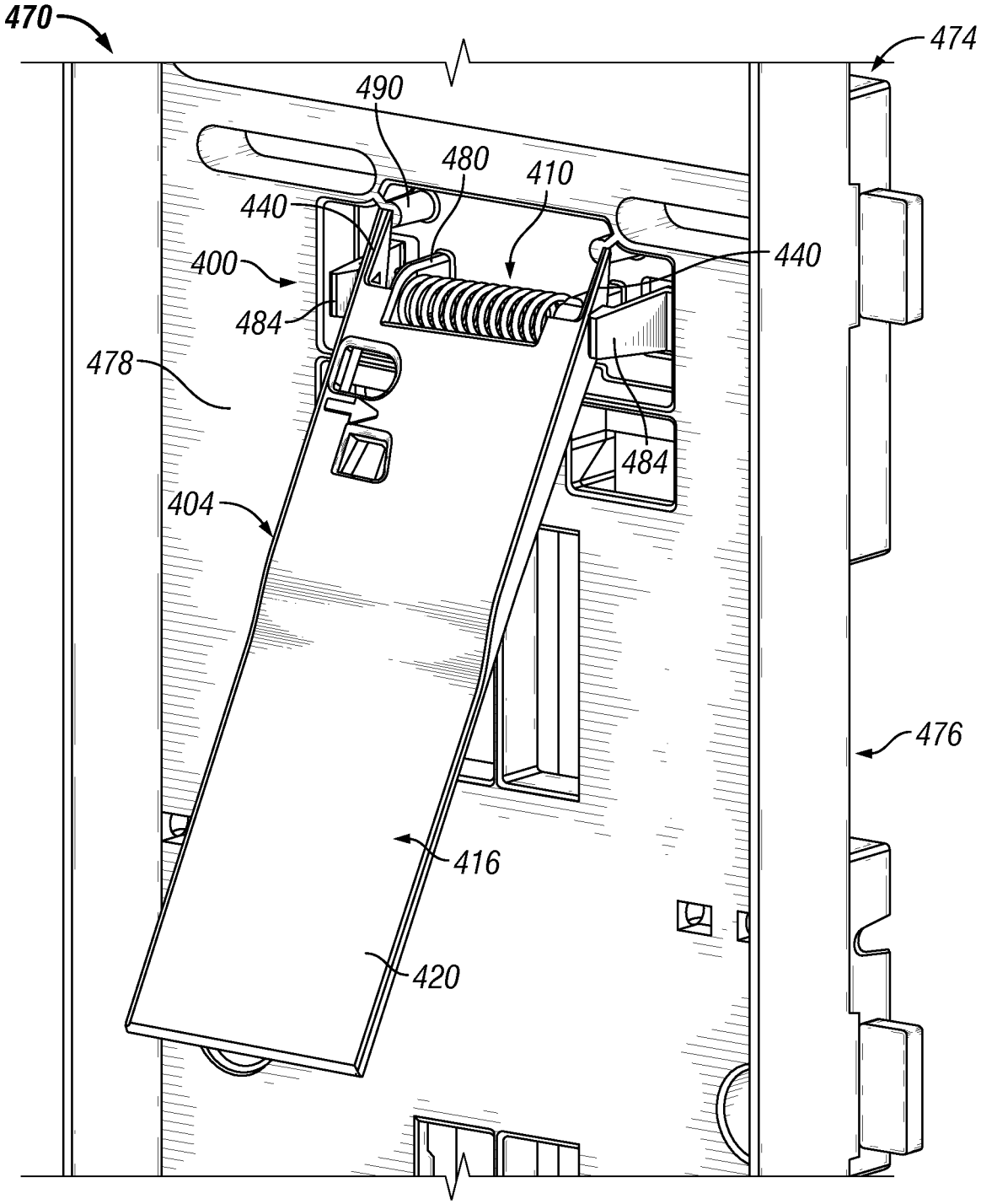
FIG. 4F is a perspective view of the resistance mechanism of FIG. 4A used as a part of a sheet product dispenser.
Figure 4G:
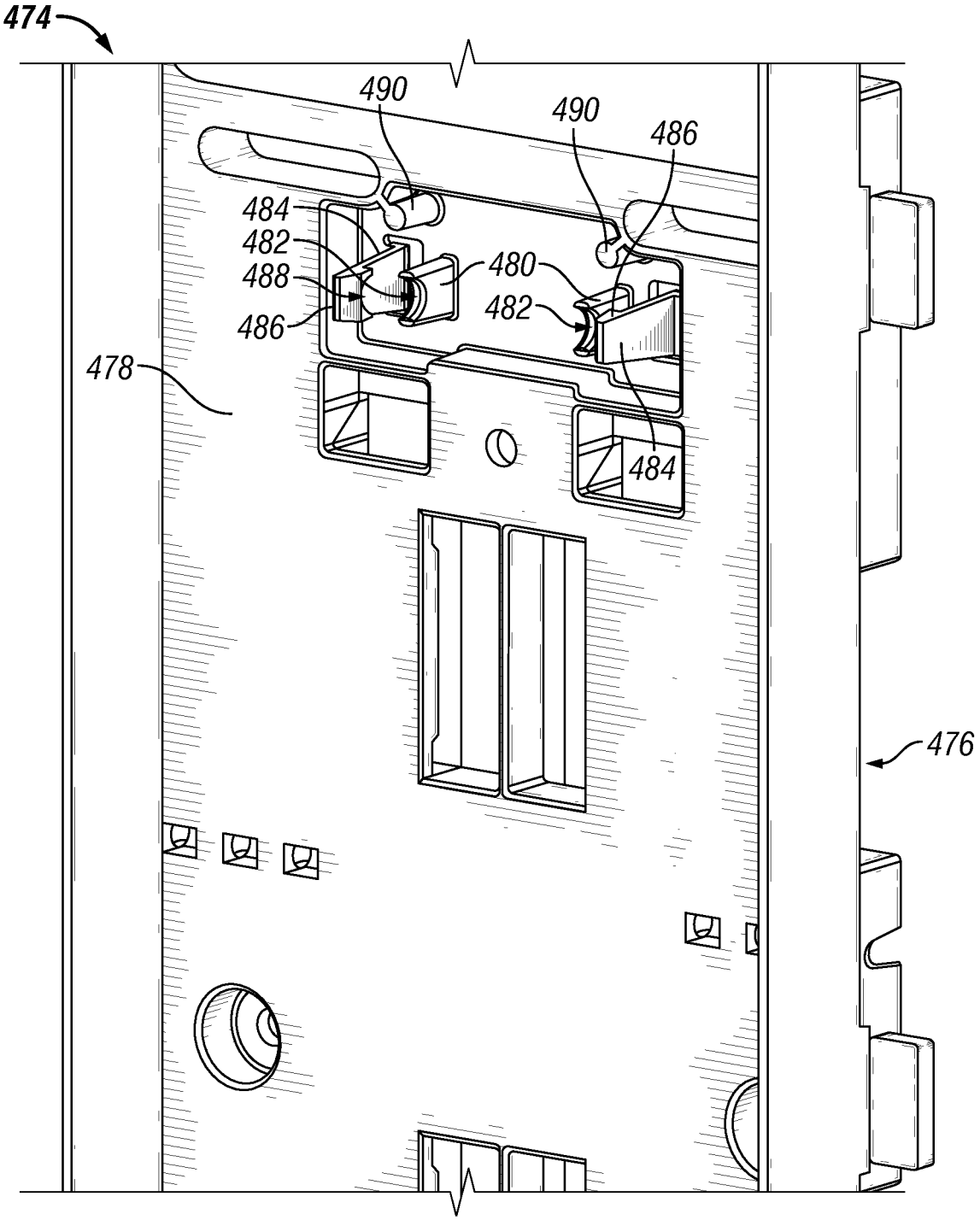
FIG. 4G is a detailed perspective view of a portion of a housing of the sheet product dispenser of FIG. 4F.
Figure 4H:
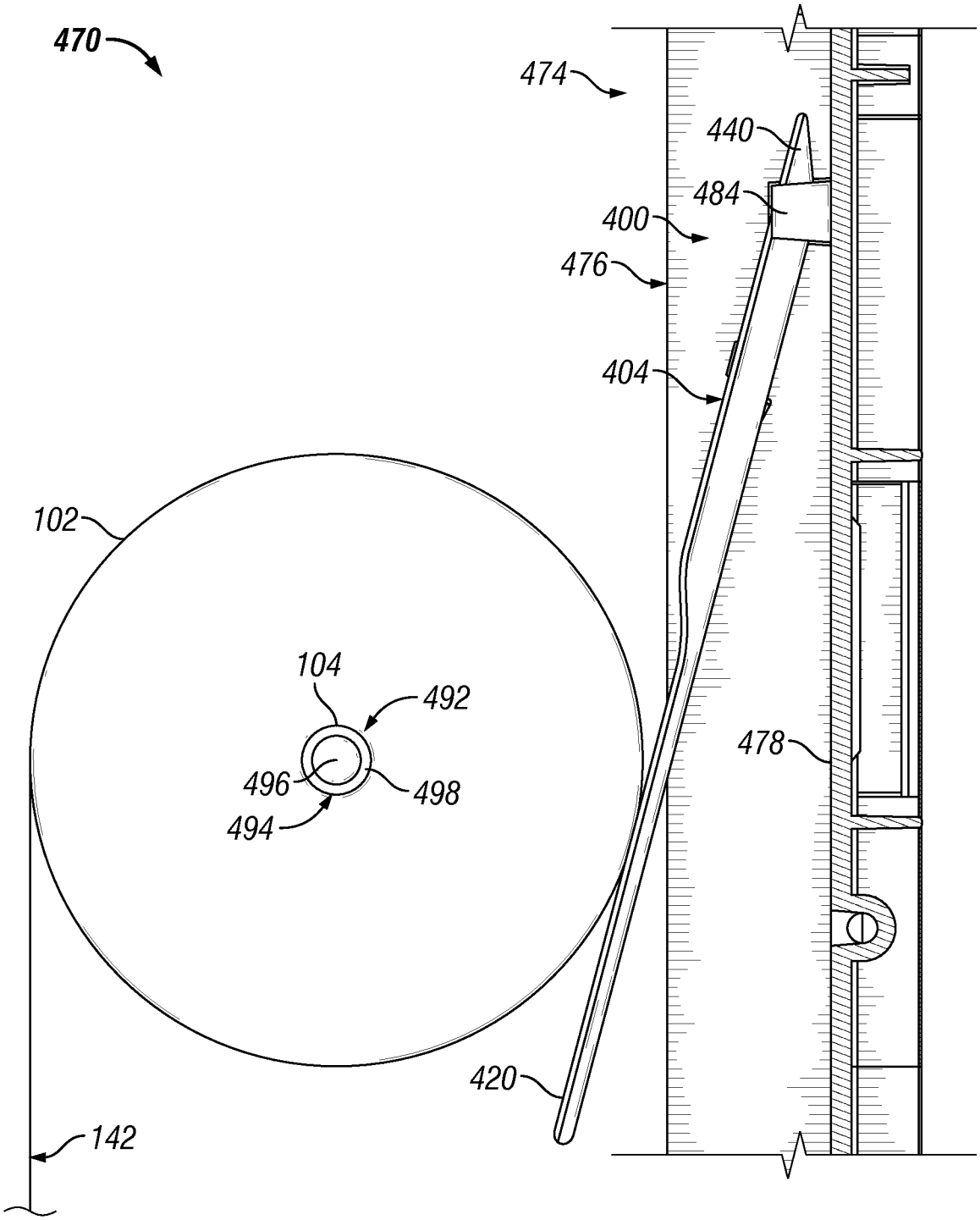
FIG. 4H is a partial cross-sectional side view of the sheet product dispenser of FIG. 4F, showing the arm of the resistance mechanism engaging a roll of sheet product.

FIGS. 4F-4H show the resistance mechanism 400 being used as a part of a sheet product dispenser 470, according to one or more embodiments of the disclosure. As described above, the resistance mechanism 400 may be provided as a part of the sheet product dispenser 470 upon original manufacture of the dispenser 470 or may be provided as a "retrofit kit" that is added to the dispenser 470 at a point in time after original manufacture thereof. The sheet product dispenser 470 may be configured to allow a user to obtain a user-determined length of sheet product from a roll 102 of sheet product supported by the dispenser 470, and the resistance mechanism 400 may be configured to engage a portion of the roll 102.

The sheet product dispenser 470 may include a housing 474, and the roll 102 of sheet product may be disposed completely, or at least partially, within the housing 474 for dispensing sheet product therefrom. The housing 474 may include a housing portion 476 that includes a wall 478 configured to allow the resistance mechanism 400 to be attached thereto. In some embodiments, as is shown, the housing portion 476 is a back housing portion, and the wall 478 is a back wall. In other embodiments, the housing portion 476 may be a front housing portion or a side housing portion, and the wall 478 may be a front wall, a back wall, a top wall, a bottom wall, or a side wall thereof.

The wall 478 may include one or more support members configured to allow the arm 404 of the resistance mechanism 400 to be pivotally connected to the wall 478. In particular, the wall 478 may include one or more first support members 480 (which also may be referred to herein as "inner support members") configured to receive at least a portion of the protrusions 430 of the arm 404 therein. For example, the wall 478 may include a pair of the first support members 480 spaced apart from one another, as is shown. Each first support member 480 may include a recess 482 configured to receive a portion of the inner portion 432 of one of the protrusions 430 therein. The recess 482 may be C-shaped or U-shaped, including a curved profile configured to support the inner portion 432 therein. The wall 478 also may include one or more second support members 484 (which also may be referred to as "outer support members") configured to receive at least a portion of the protrusions 430 of the arm 404 therein. For example, the wall 478 may include a pair of the second support members 484 spaced apart from one another and configured to receive the protrusions 430 therebetween, as is shown. Each second support member 484 may include a tab 486 extending inward toward the other second support member 484. Each tab 486 may include a recess 488 configured to receive a portion of the outer portion 434 of one of the protrusions 430 therein. The recess 488 may be C-shaped or U-shaped, including a curved profile configured to support the outer portion 434 therein. In some embodiments, the wall 478 also includes one or more protrusions 490 configured to engage the tabs 440 of the arm 404 when the arm 404 is connected to the wall 478. For example, the wall 478 may include a pair of the protrusions 490 spaced apart from one another, as is shown.

During installation of the resistance mechanism 400, the spring 410 may be elastically loaded by moving the second spring arm 426 from the first position to the second position, as described above. With the second spring arm 426 in the second position, the arm 404 may be connected to the wall 478 of the housing 474. In particular, the protrusions 430 of the arm 404 may be connected to the support members 480, 484 such that the inner portions 432 of the protrusions 430 are received at least partially within the recesses 482 of the first support members 480 and the outer portions 434 of the protrusions are received at least partially within the recesses 488 of the second support members 484. In this manner, the arm 404 may be pivotally connected to the wall 478. In some embodiments, the second support members 484 are configured to deflect outward (i.e., away from one another) as the protrusions 430 are inserted therebetween, and then to return to a natural state to retain the protrusions 430. The tabs 486 of second support members 484 may be tapered, as is shown, to facilitate insertion of the protrusions 430 and deflection of the second support members 484. After connecting the arm 404 to the wall 478, the second spring arm 426 may be released from the second position (i.e., released from the hook 454), such that the second spring arm 426 rotates away from the back side 418 of the arm 404 and engages the wall 478. In this manner, the spring 410 may bias the arm 404 (i.e., cause the arm 404 to pivot) away from the wall 478. The pivotal movement of the arm 404 relative to the wall 478 may be limited by the tabs 440 of the arm 404 engaging the wall 478, such as the protrusions 490 thereof. The limited pivotal movement of the arm 404 may facilitate loading of the roll 102 of sheet product in the dispenser 470.

The sheet product dispenser 470 also may include a roll support mechanism 492 configured to rotatably support the roll 102 of sheet product for dispensing therefrom. In some embodiments, the roll support mechanism 492 includes a spindle 494. The spindle 494 may include a spindle shaft 496 and a spindle sleeve 498, which may be configured in a manner similar to the spindle 154 described above. After loading the roll 102 of sheet product on the roll support mechanism 492, the engagement surface 420 of the arm 404 may engage the outer surface of the roll 102, as is shown in FIG. 4H.

During use of the dispenser 470, a user grasps and applies a pull force to the tail portion 142 of the roll 102 of sheet product sufficient to rotate the roll 102 about the roll support mechanism 492 and unwind a length of sheet product from the roll 102. The roll support mechanism 492 may be configured to provide a pull force resistance opposing the pull force applied by the user. The pull force resistance provided by the roll support mechanism 492 may be a function of an outer diameter of the roll 102 and a rotational resistance generated by the roll support mechanism 492. Based on the configuration of the roll support mechanism 492, the rotational resistance may result from frictional forces generated between one or more rotating components and one or more stationary components of the roll support mechanism 492 and/or between the roll 102 and one or more stationary components of the roll support mechanism 492 as the roll 102 rotates. The pull force resistance provided by the roll support mechanism 492 may vary throughout a life of the roll 102 of sheet product, as an outer diameter of the roll 102 decreases. In particular, based on the configuration of the roll support mechanism 492, as the outer diameter of the roll 102 decreases, the pull force resistance provided by the roll support mechanism 492 may increase.

The resistance mechanism 400 also is configured to provide a pull force resistance opposing the pull force applied by the user. The pull force resistance provided by the resistance mechanism 400 may be a function of a frictional resistance generated by the resistance mechanism 400 and the portion of the roll 102 engaged thereby. Based on the configuration of the resistance mechanism 400, the frictional resistance may result from frictional forces generated between the arm 404 and the surface of the roll 102 engaged thereby as the roll 102 rotates about the roll support mechanism 492. In particular, significant frictional forces may be generated between the engagement surface 420 of the arm 404 and the outer surface of the roll 102 as the roll 102 rotates. According to various embodiments, the frictional resistance also may result, at least partially, from frictional forces generated between the roll 102 and any other feature or component of the resistance mechanism 400 that frictionally engages the roll 102 as the roll 102 rotates about the roll support mechanism 492.

The pull force resistance provided by the resistance mechanism 400 may vary throughout the life of the roll 102 of sheet product, as the outer diameter of the roll 102 decreases. As described above, the pull force resistance provided by the resistance mechanism 400 may be a function of the frictional resistance generated by the resistance mechanism 400 and the portion of the roll 102 engaged thereby. Based on the configuration of the resistance mechanism 400, the frictional forces generated between the arm 404 and the outer surface of the roll 102 may decrease throughout the life of the roll 102. In particular, the frictional forces generated between the arm 404 and the roll 102 may decrease as an angle of twist (i.e., elastic loading relative to a natural state) of the spring 410 decreases throughout the life of the roll 102. Accordingly, as the outer diameter of the roll 102 decreases, the pull force resistance provided by the resistance mechanism 400 may decrease.

In a preferred embodiment, a sum of the pull force resistance provided by the roll support mechanism 492 and the pull force resistance provided by the resistance mechanism 400 is within a range of 36 grams-force and 96 grams-force, a range of 46 grams-force and 86 grams-force, or a range of 56 grams-force and 76 grams-force, throughout the life of the roll 102 or throughout a majority of the life of the roll 102. In this manner, a total pull force resistance provided by the dispenser 470 (and thus experienced by the user when applying the pull force to the tail portion 142 of the roll 102) is, in a preferred embodiment, within a range of 36 grams-force and 96 grams-force, a range of 46 grams-force and 86 grams-force, or a range of 56 grams-force and 76 grams-force, throughout the life of the roll 102 or throughout a majority of the life of the roll 102.

In some embodiments, the pull force resistance provided by the roll support mechanism 492 is relatively small and thus constitutes a relatively small portion of the total pull force resistance provided by the dispenser 470. In other embodiments, the pull force resistance provided by the roll support mechanism 492 is relatively large and thus constitutes a relatively large portion of the total pull force resistance provided by the dispenser 492. In some embodiments, the pull force resistance provided by the roll support mechanism 492 is within a range of 5 grams-force and 35 grams-force throughout the life of the roll 102 or throughout a majority of the life of the roll 102. In some embodiments, the pull force resistance provided by the roll support mechanism 492 varies from between 5 grams-force and 25 grams-force at the beginning of the life of the roll 102 (i.e., when the roll 102 is full) to between 15 grams-force and 35 grams-force at the end of the life of the roll (i.e., when the roll 102 is completely depleted). The materials, surface treatments, dimensions, and mating contact areas of the spindle sleeve 498, the spindle shaft 496, and any other feature or component of the roll support mechanism 492 that frictionally engages either the spindle sleeve 498 or the roll 102 may be selected such that the pull force resistance provided by the roll support mechanism 492 is within a desired range throughout the life of the roll 102 or throughout a majority of the life of the roll 102.

In some embodiments, the pull force resistance provided by the resistance mechanism 400 is relatively small and thus constitutes a relatively small portion of the total pull force resistance provided by the dispenser 470. In other embodiments, the pull force resistance provided by the resistance mechanism 400 is relatively large and thus constitutes a relatively large portion of the total pull force resistance provided by the dispenser 470. In some embodiments, the roll support mechanism 492 is omitted from the dispenser 470, and thus the pull force resistance provided by the resistance mechanism 400 constitutes the entirety of the total pull force resistance provided by the dispenser 470. In some embodiments, the pull force resistance provided by the resistance mechanism 400 is within a range of 35 grams-force and 90 grams-force throughout the life of the roll 102 or throughout a majority of the life of the roll 102. In some embodiments, the pull force resistance provided by the resistance mechanism 400 varies from between 75 grams-force and 90 grams-force at the beginning of the life of the roll 102 to between 35 grams-force and 50 grams-force at the end of the life of the roll. The spring constant (i.e., stiffness) of the spring 410 and the materials, surface treatments, dimensions, and mating contact areas of the arm 404 and any other feature or component of the resistance mechanism 400 that frictionally engages the roll 102 may be selected such that the pull force resistance provided by the resistance mechanism 400 is within a desired range throughout the life of the roll 102 or throughout a majority of the life of the roll 102.

The sheet product dispensers and methods for providing a desired range of pull force resistance can be further understood with reference to the following non-limiting examples.

Example 1—Pull Force Resistance Testing

Figure 5:
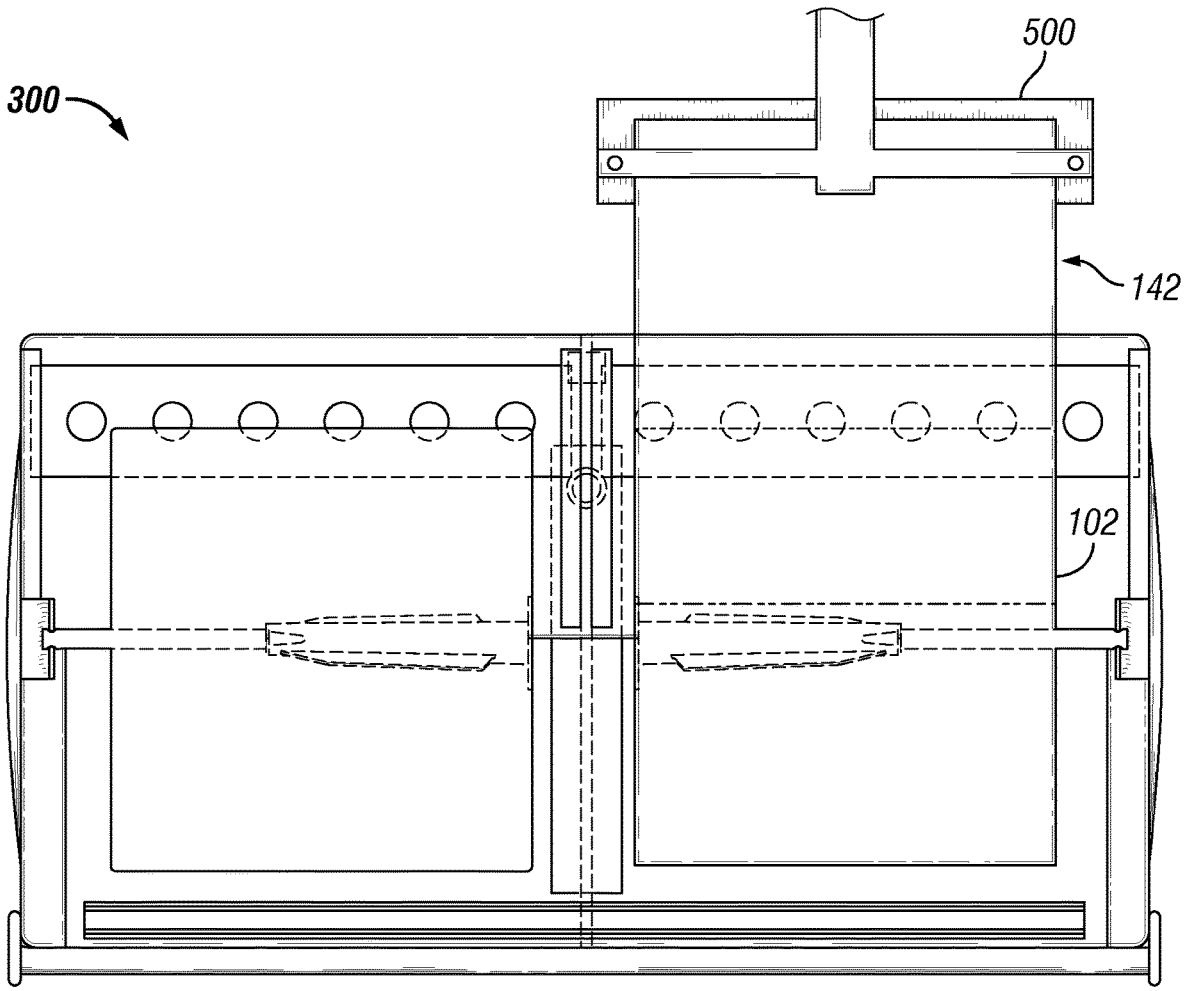
FIG. 5 is a front view of a test setup for measuring a pull force resistance provided by the sheet product dispenser of FIG. 3A.

Testing of various sheet product dispensers was conducted to determine a pull force resistance provided by each dispenser at different points throughout a life of a roll of sheet product dispensed thereby. FIG. 5 shows a test setup used to measure the pull force resistance provided by each dispenser, with the sheet product dispenser 300 shown as an example. With the second housing portion 214 removed from the dispenser 300, the first housing portion 212 was secured to a mounting surface in a conventional manner and also to a base of a Model No. 5966 Instron® tensile tester. A roll 102 of sheet product was loaded onto the dispenser 300 in an under-hand manner, and the tail portion 142 thereof was clamped into a jaw 500 of the tensile tester. In this manner, the outer layer of the sheet product extended from the bottom of the roll 102 and along the front of the roll 102 upward to the jaw 500.

For each test run, the tail portion 142 was pulled upward at a rate of 30 inches per minute over a total distance of 12 inches. A pull force resistance provided by the dispenser 200 was measured using a 20-pound load cell. An average pull force resistance was calculated from the data measured between 2 inches and 10 inches of upward travel of the jaw 500. This selection of data allowed for any slack in the roll 102 to be pulled out in order to achieve a smooth, even tension in the sheet product for determining the average pull force resistance provided by the dispenser 300.

For each of the sheet product dispensers tested, test runs were completed with the roll 102 positioned on the first side of the dispenser and also with the roll 102 positioned on the second side of the dispenser. For each side, test runs were completed with the roll 102 having a relatively large outer diameter of between 4.98 inches and 5.82 inches and also with the roll 102 having a relatively small outer diameter of between 2.52 inches and 2.96 inches. For some of the dispensers, additional test runs were completed with the roll 102 having other outer diameter values, as is described below. The same roll 102 of sheet product was used for all of the test runs of all of the dispensers. In this manner, the roll 102 was moved from the first side to the second side for each dispenser, and from one dispenser to another. A length of sheet product was removed during each test run, and the sheet product was not rewound between test runs.

The pull force resistance testing was completed using a single roll of Compact® Coreless 2-ply Bath Tissue (SKU 19378), manufactured by Georgia-Pacific®. The bath tissue had a basis weight of 18.4, a caliper of 48.0 mils/8 ply using TAPPI™ 411D, a central opening diameter of 0.625 inches, 1510 sheets, a sheet width of 3.88 inches, a sheet length of 4.15 inches, a roll length of 522.2 feet, and a roll outer diameter of 5.84 inches.

Figure 6:
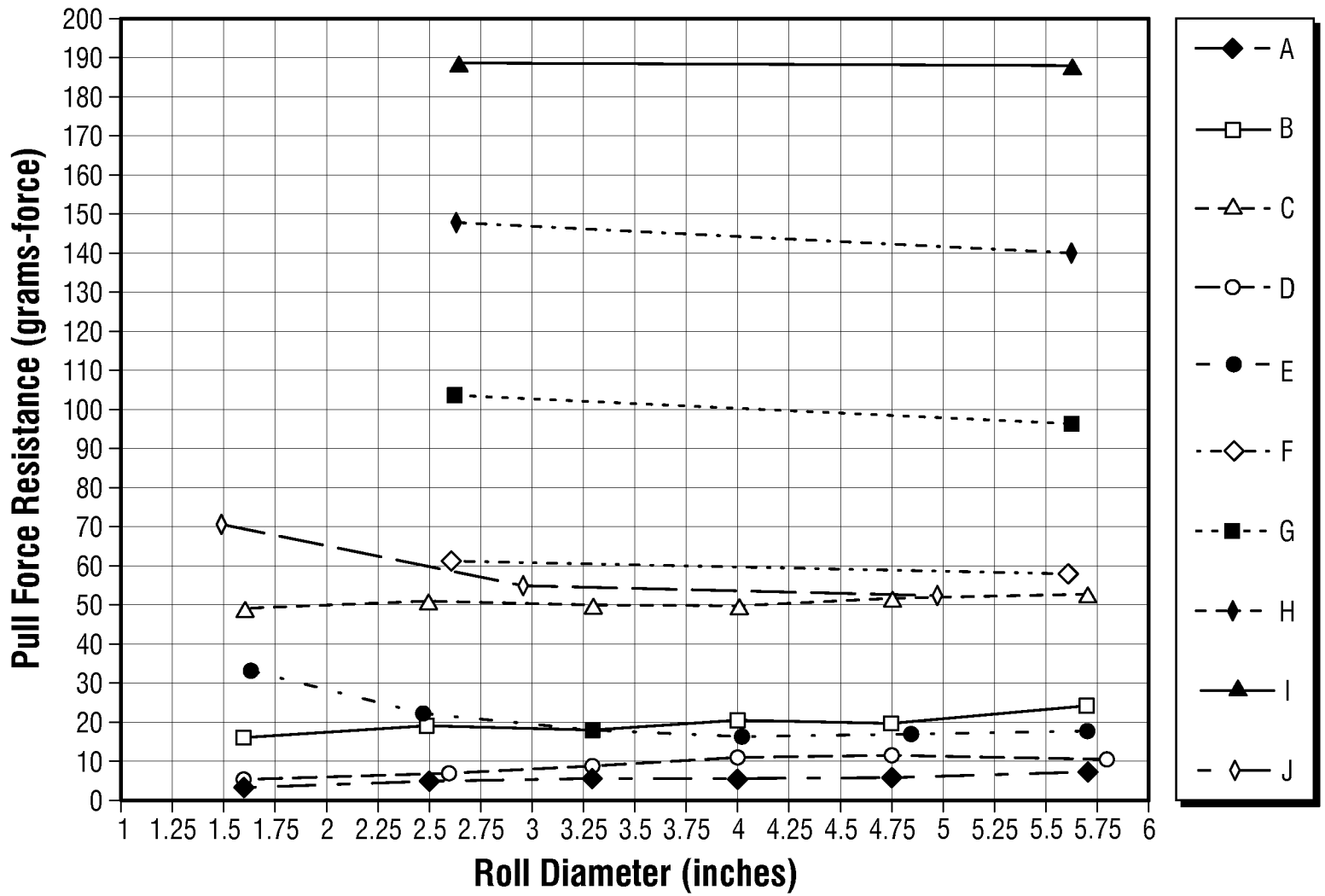
FIG. 6 is a graph of a pull force resistance provided by various sheet product dispensers as a function of an outer diameter of a roll of sheet product dispensed thereby.

FIG. 6 shows a graph of the pull force resistance provided by each of ten different dispensers (dispensers A-J) tested as a function of the outer diameter of the roll of bath tissue dispensed thereby. Dispenser A was an embodiment of the sheet product dispenser 300 with the load member 374 removed, such that the resistance mechanisms 370, 372 did not provide any pull force resistance. Dispensers B and C were embodiments of the sheet product dispenser 300 including the load members 374 formed of a first material and having different mass values. Dispenser D was a dispenser including a roll support mechanism but no resistance mechanism. The roll support mechanism included a spindle having a stationary spindle shaft and a rotating spindle sleeve. The spindle sleeve was not flexible and did not include any fins for engaging the roll 102. Dispenser E was a dispenser including a roll support mechanism but no resistance mechanism. The roll support mechanism included a spindle having a stationary spindle shaft and a rotating spindle sleeve. The spindle sleeve was flexible and included fins for engaging the roll 102. Dispensers F, G, H, and I were embodiments of the sheet product dispenser 300 including the load members 374 formed of a second material and having different mass values. Dispenser J was an embodiment of the sheet product dispenser 200 including the resistance mechanisms 270, 272 having the arm 274 and the torsion spring 280.

Each data point on the graph is an average of the average pull force resistance calculated for the test runs completed for the first side and the second side of each dispenser at a corresponding outer diameter of the roll. As is shown, each of the dispensers A-J has a data point for a relatively large outer diameter of between 4.98 inches and 5.82 inches and another data point for a relatively small outer diameter of between 2.52 inches and 2.96 inches. Dispensers A, B, C, D, E, and J also have data points for additional roll outer diameter values, as is shown in the graph.

Figure 7:
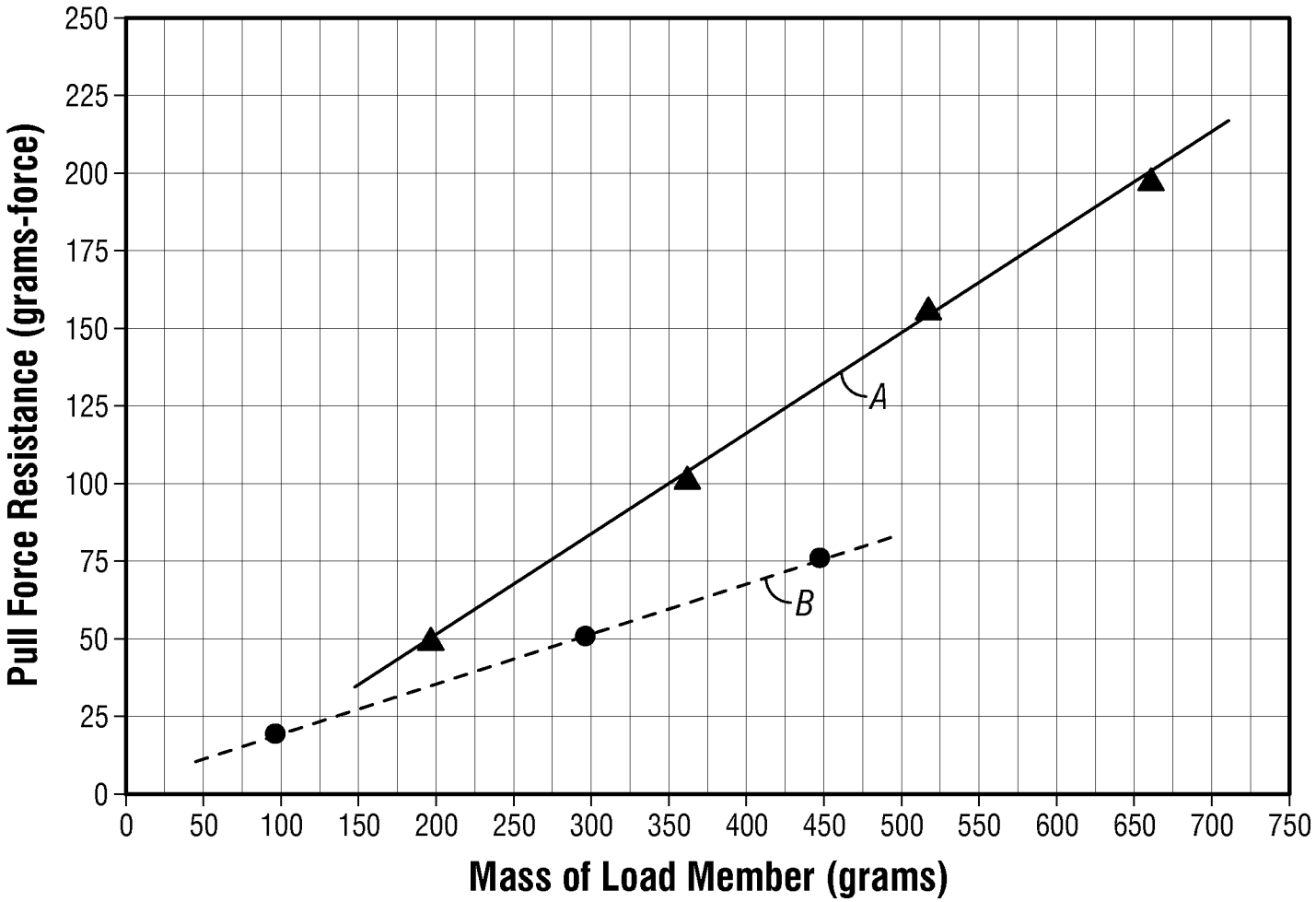
FIG. 7 is a graph of a pull force resistance provided by various embodiments of the sheet product dispenser of FIG. 3A as a function of a mass of a load member of the resistance mechanism thereof, showing a first fitted line for a first group of similar embodiments and a second fitted line for a second group of similar embodiments.

FIG. 7 shows a graph of the pull force resistance provided by various embodiments of the sheet product dispenser 300 as a function of a mass of the load member 374 of the resistance mechanism 370, 372. The pull force resistance provided by each embodiment was measured and averaged in the manner described above. The first fitted line A and the corresponding data points are for a first group of embodiments of the dispenser 300 for which the load member 374 was formed of a first material. The second fitted line B and the corresponding data points are for a second group of embodiments of the dispenser 300 for which the load member 374 was formed of a second material. As will be appreciated, the material of the load member 374 (which affects the coefficient of friction between the load member 374 and the roll 102 of sheet product) and the mass of the load member 374 (which affects the normal force acting on the load member 374) are key variables that affect the frictional forces generated between the load member 374 and the roll 102 and thus the pull force resistance provided by the dispenser 300. Accordingly, upon deriving a fitted line for a group of embodiments of the dispenser 300 for which the load member 374 was formed of the same material, the mass of the load member 374 may be selected such that an embodiment of the dispenser 300 providing a desired range of pull force resistance may be achieved.

Example 2—Study of Sheet Product Usage as a Function of Pull Force Resistance Following the pull force resistance testing described above, a sheet product usage study was conducted to determine the effect of different amounts of pull force resistance on sheet product usage. The study was conducted in a blind manner in a confidential space, as one of each of the dispensers A-J was installed in a restroom stall in a men's restroom and in a restroom stall in a women's restroom for a period of time at the same medium-traffic location. Notably, the dispenser I was used only briefly for the sheet product usage study, as the pull force resistance produced thereby was determined to be too high, resulting in an unacceptable user experience due to tabbing and tearing of the sheet product. The housings of the dispensers concealed the inner components thereof, such that users were not able to view the respective resistance mechanisms used.

The study was conducted using rolls of Compact® Coreless 2-ply Bath Tissue (SKU 19378), the same bath tissue as was used in the pull force resistance testing described above. All of the rolls used were from a single production run to avoid any risk of manufacturing inconsistencies. The rolls were inspected by measuring the roll outer diameter, the central aperture diameter, the sheet count, the sheet length, and the caliper thereof.

Throughout the study, the outer diameter of the rolls loaded in the sheet product dispensers was measured on an ongoing basis. Upon each measurement, a reduction in the outer diameter as the rolls were depleted was used to calculate an estimated number of sheets used since the prior measurement. When a roll was removed from a dispenser, any remaining sheets were manually counted, and the total number of sheets used was adjusted as necessary. Accordingly, the total amount of sheet product used over the period of the study was determined for each of the dispensers. The rolls were changed at a normal frequency.

For each dispenser, the number of use occasions during the study was measured by either a mechanical counter affixed to a door of the restroom stall or an infrared (IR) motion detector connected to a data logger. Both methods measured the total number of stall visits over the period of the study. The restroom stalls required routine cleaning and roll maintenance, and the janitorial and testing technician visits were subtracted from the total number of stall visits to arrive at the total number of use occasions. For the different dispensers studied, the total number of use occasions ranged from 500 to 3500 total use occasions (including the use occasions for the dispenser in the men's restroom and the dispenser in the women's restroom).

For each of the different dispensers studied, the total amount of sheet product used and the total number of use occasions were calculated by adding the respective values measured from the dispenser in the men's restroom and the dispenser in the women's restroom. The total sheet product usage was then calculated by dividing the total amount of sheet product used by the total amount of use occasions and normalized into a single number representing an overall average length of sheet product dispensed per use occasion. The total sheet product usage was normalized using the 2008 US census ratio of men to women in the workforce, according to which there were 82,520,000 men and 71,767,000 women in the US civilian workforce. Men were estimated to have 1.11 restroom stall visits per day, and women were estimated to have 2.61 restroom stall visits per day, yielding a weighted average of 2.35 restroom stall visits per day for an average worker.

Figure 8:
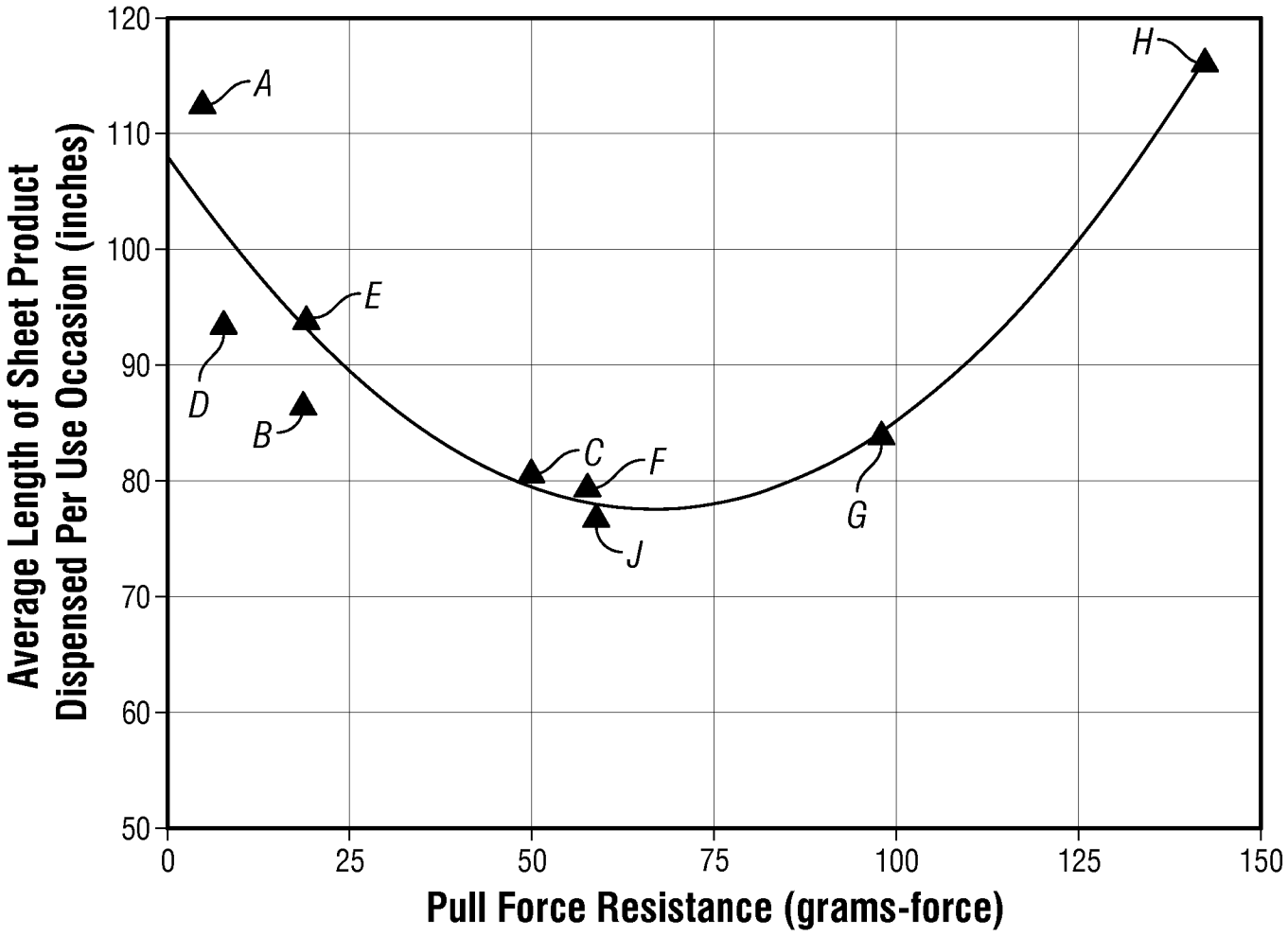
FIG. 8 is a graph of an average length of sheet product dispensed from various sheet product dispensers per use occasion as a function of a pull force resistance provided by the sheet product dispensers, showing a fitted curve for all of the dispensers.
Figure 9:
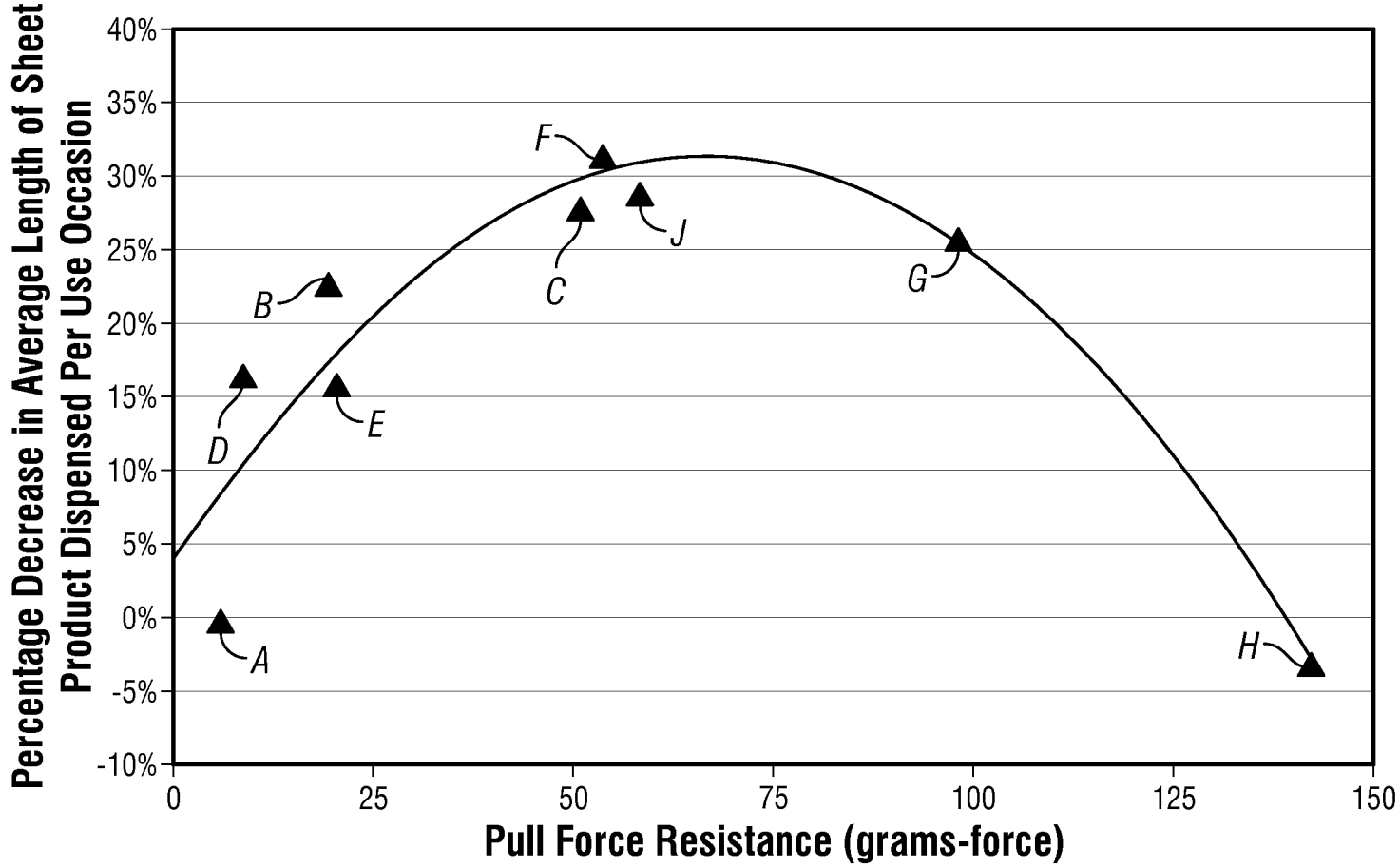
FIG. 9 is a graph of a percentage decrease in an average length of sheet product dispensed from various sheet product dispensers per use occasion as a function of a pull force resistance provided by the sheet product dispensers, showing a fitted curve for all of the dispensers.

FIG. 8 shows a graph of the overall average length of sheet product dispensed per use occasion as a function of the average pull force resistance provided by each of the different dispensers A-H and J. As noted above, the dispenser I was used only briefly for the sheet product usage study, and thus not enough data were collected therefor to generate a reliable data point. Each data point on the graph is the overall average length of sheet product dispensed per use occasion as a function of the average pull force resistance provided by the different dispensers A-H and J. The fitted curve shows the observed relationship between sheet product usage and pull force resistance provided by a sheet product dispenser for Compact® Coreless 2-ply Bath Tissue. FIG. 9 shows the overall percentage decrease in the average length of sheet product dispensed per use occasion as a function of the pull force resistance provided by the different dispensers A-H and J. The percentage decrease was calculated using dispenser A (the dispenser having the lowest pull force resistance) as a baseline value.

Example 3—Study of Sheet Product Usage as Function of Sheet Product Caliper

The trends shown in FIGS. 8 and 9 are believed to similarly apply to sheet product having different calipers. During a different study conducted to determine the effect of sheet product caliper on sheet product usage, it was determined that sheet product usage generally decreases as sheet product caliper increases. The study was conducted in a blind manner in a confidential space, as six different types of commercial single roll bath tissue were installed in restroom stalls in a men's restroom and a women's restroom for a period of time in the same medium-traffic location.

For each of the different types of bath tissue studied, the total amount of sheet product used and the total number of use occasions over the period of the study were determined in a manner similar to that described above with respect to the study of sheet product usage as a function of pull force resistance. The total sheet product usage was then calculated by dividing the total amount of sheet product used by the total amount of use occasions and normalized into a single number representing an overall average length of sheet product dispensed per use occasion.

Figure 10:
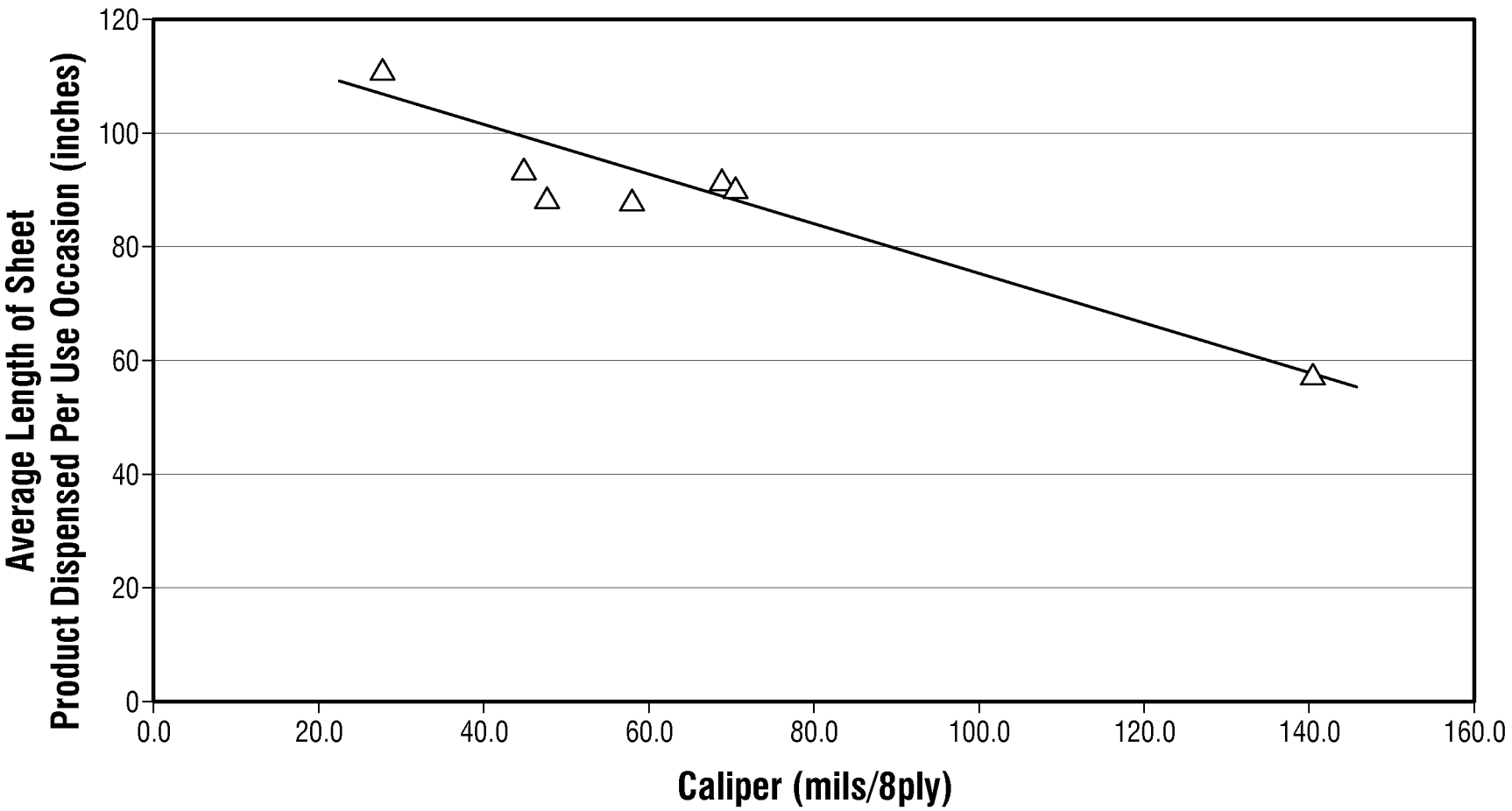
FIG. 10 is a graph of an average length of sheet product dispensed from various sheet product dispensers per use occasion as a function of a caliper of the sheet product dispensed, showing a fitted line for the data collected.

FIG. 10 shows a graph of the average length of sheet product dispensed from various sheet product dispensers per use occasion as a function of the caliper of the sheet product dispensed. Each data point on the graph is an overall average length of sheet product dispensed per use occasion as a function of the caliper of the different types of bath tissue studied. The fitted line shows the observed trend, indicating that sheet product usage generally decreases as sheet product caliper increases.

In view of the trend shown in FIG. 10, it is believed that the general shape of the fitted curve shown in FIG. 8 would hold true for sheet product having different calipers, although the curve potentially would be shifted upward for sheet product having a caliper less than that of the Compact® Coreless 2-ply Bath Tissue (48.0 mils/8 ply) and downward for sheet product having a caliper greater than that of the Compact® Coreless 2-ply Bath Tissue.

Sheet Product Dispensers and Methods Providing a Substantially Constant Pull Force Resistance As described above, conventional sheet product dispensers and related methods for dispensing sheet product may provide resistance opposing a pull force applied by a user to rotate a roll of sheet product about a roll support mechanism and unwind a length of sheet product from the roll. For example, according to some dispensers, the roll support mechanism engages a central opening of the roll and provides rotational resistance opposing the pull force applied by the user. According to some dispensers, an additional resistance mechanism engages an outer surface of the roll and provides frictional resistance opposing the pull force applied by the user. As is known, the rotational resistance and/or the frictional resistance provided by conventional sheet product dispensers may vary significantly over a life of the roll, as an outer diameter of the roll decreases, and thus the resulting effect on the pull force required to rotate the roll also may vary significantly. Ultimately, significant variation of the total resistance provided by conventional sheet product dispensers and related methods may result in an undesirable user experience and/or may cause the user to knowingly or unknowingly dispense excess sheet product.

As compared to conventional sheet product dispensers and related methods for dispensing sheet product, the improved sheet product dispensers and methods described herein advantageously may improve user experience. In particular, the improved dispensers and methods may provide a substantially constant pull force resistance throughout at least a majority of a life of a roll of sheet product dispensed thereby. In this manner, the improved dispensers and methods may provide a consistent user feel from one use occasion to another. Moreover, the improved dispensers and methods may reduce unnecessary waste of sheet product and decrease overall cost to a provider of the sheet product when the constant pull force resistance is selected for optimal efficiency.

As described above with respect to the sheet product dispenser 100, each of the pull force resistance provided by the roll support mechanism 150 and the pull force resistance provided by the resistance mechanism 170 may vary throughout the life of the roll 102, as the outer diameter of the roll 102 decreases. In particular, the pull force resistance provided by the roll support mechanism 150 may increase throughout the life of the roll 102, and the pull force resistance provided by the resistance mechanism 170 may decrease throughout the life of the roll 102. In a similar manner, with respect to the sheet product dispenser 200, each of the pull force resistance provided by the roll support mechanism 250 and the pull force resistance provided by the resistance mechanism 270 may vary throughout the life of the roll 102, as the outer diameter of the roll 102 decreases. In particular, the pull force resistance provided by the roll support mechanism 250 may increase throughout the life of the roll 102, and the pull force resistance provided by the resistance mechanism 270 may decrease throughout the life of the roll 102.

Figure 11A:
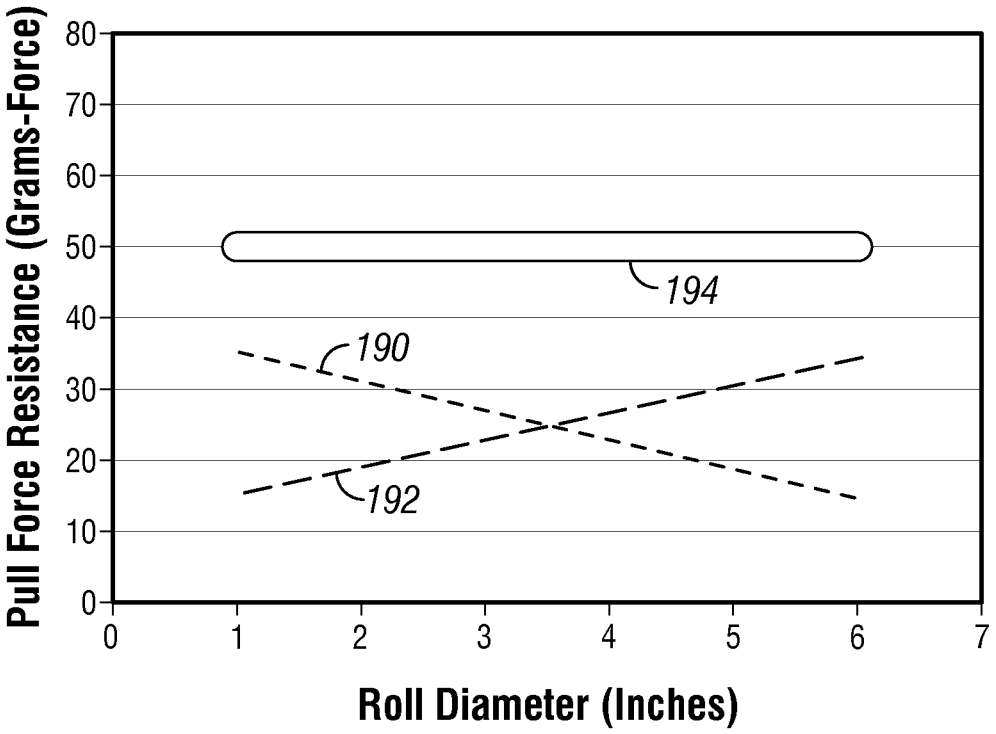
FIG. 11A is a graph of a pull force resistance provided by each of a roll support mechanism and a resistance mechanism of a sheet product dispenser as well as a total pull force resistance provided by the dispenser as a function of an outer diameter of a roll of sheet product dispensed thereby, in accordance with one or more embodiments of the disclosure.
Figure 11B:
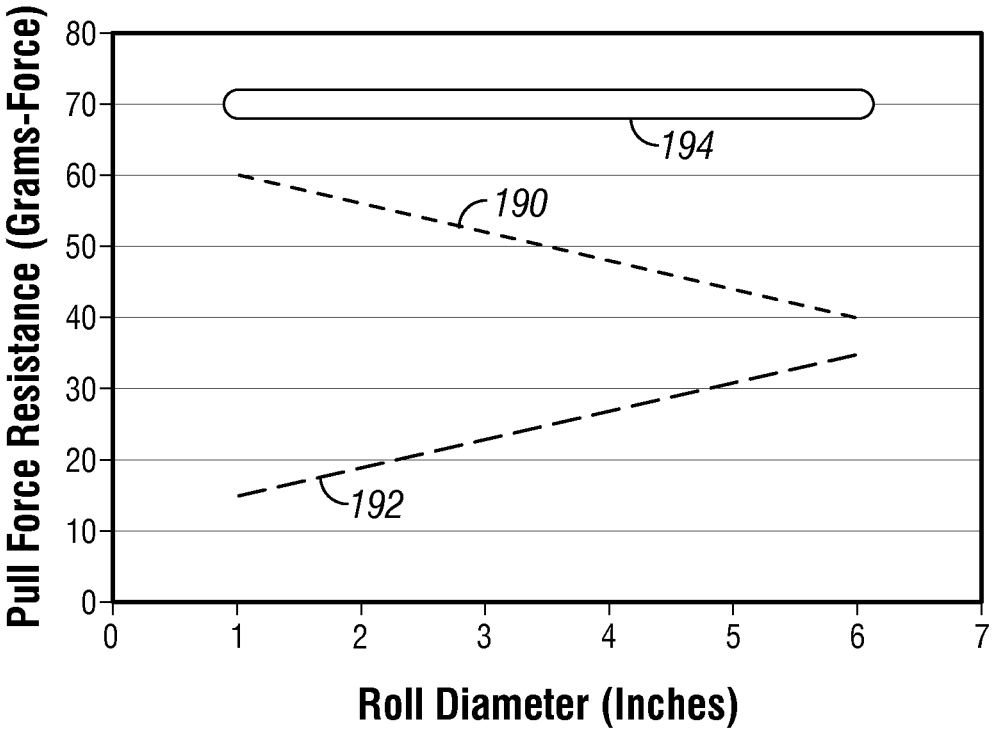
FIG. 11B is a graph of a pull force resistance provided by each of a roll support mechanism and a resistance mechanism of a sheet product dispenser as well as a total pull force resistance provided by the dispenser as a function of an outer diameter of a roll of sheet product dispensed thereby, in accordance with one or more embodiments of the disclosure.

FIGS. 11A and 11B each show a graph of a pull force resistance provided by each of a roll support mechanism and a resistance mechanism of a sheet product dispenser as well as a total pull force resistance provided by the dispenser as a function of an outer diameter of a roll of sheet product dispensed thereby, in accordance with one or more embodiments of the disclosure. In some embodiments, the sheet product dispenser may be the sheet product dispenser 100, which may include a roll support mechanism, such as the roll support mechanism 150 described above, and a resistance mechanism, such as the resistance mechanism 170 described above. In some embodiments, the sheet product dispenser may be the sheet product dispenser 200, which may include a roll support mechanism, such as the roll support mechanism 250 described above, and a resistance mechanism, such as the resistance mechanism 270 described above.

Referring to the graphs, line 190 represents the pull force resistance provided by the roll support mechanism, which increases throughout the life of the roll 102 of sheet product dispensed by the dispenser. Line 192 represents the pull force resistance provided by the resistance mechanism, which decreases throughout the life of the roll 102. Line 194 represents a sum of the pull force resistance provided by the roll support mechanism and the pull force resistance provided by the resistance mechanism, which is substantially constant throughout the life of the roll 102. The roll support mechanism and the resistance mechanism may be configured such that a rate of increase of the pull force resistance provided by the roll support mechanism is substantially equal to a rate of decrease of the pull force resistance provided by the resistance mechanism, as is shown. In this manner, the sum of the pull force resistance provided by the roll support mechanism and the pull force resistance provided by the resistance mechanism is substantially constant throughout the life of the roll 102. Accordingly, the total pull force resistance provided by the dispenser and experienced by the user is substantially constant throughout the life of the roll 102, and thus the dispenser may improve user experience by providing a consistent user feel from one use occasion to another.

As will be appreciated, the sum of the pull force resistances may be adjusted to a desired level by increasing or decreasing the range of one or both of the pull force resistance provided by the roll support mechanism and the pull force resistance provided by the resistance mechanism. For example, relative to the graph of FIG. 11A, the graph of FIG. 11B shows an increase in the range of the pull force resistance provided by the roll support mechanism (as indicated by line 190), resulting in a corresponding increase in the sum of the pull force resistances (as indicated by line 194).

In some embodiments, the pull force resistance provided by the roll support mechanism and the pull force resistance provided by the resistance mechanism each are selected by a manufacturer of the dispenser, as desired. In this manner, the manufacturer selects the total pull force resistance provided by the dispenser, as desired. In other embodiments, the pull force resistance provided by the roll support mechanism and the pull force resistance provided by the resistance mechanism each are selected by an owner or a user of the dispenser, as desired. In this manner, the owner or the user selects the total pull force resistance provided by the dispenser, as desired. For example, in some embodiments, the dispenser includes one or more adjustment mechanisms configured to adjust (i.e., increase or decrease) the pull force resistance provided by the roll support mechanism, the pull force resistance provided by the resistance mechanism, or both. In this manner, the total pull force resistance provided by the dispenser may be adjusted to a desired level. Based on the configuration of the roll support mechanism and the resistance mechanism, the total pull force resistance provided by the dispenser after adjustment may be substantially constant, according to the relationships described above. In some embodiments, access to or adjustment of the adjustment mechanisms may be restricted to the owner of the dispenser, preventing adjustment by other users.

In some embodiments, a sum of the pull force resistance provided by the roll support mechanism and the pull force resistance provided by the resistance mechanism is within a range of 36 grams-force and 96 grams-force, a range of 46 grams-force and 86 grams-force, or a range of 56 grams-force and 76 grams-force, throughout the life of the roll 102 or throughout a majority of the life of the roll 102. In this manner, the total pull force resistance provided by the dispenser (and thus experienced by the user when applying the pull force to the tail portion 142 of the roll 102) is, in some embodiments, within a range of 36 grams-force and 96 grams-force, a range of 46 grams-force and 86 grams-force, or a range of 56 grams-force and 76 grams-force throughout the life of the roll 102 or throughout a majority of the life of the roll 102.

Although certain embodiments of the disclosure are described herein and shown in the accompanying drawings, one of ordinary skill in the art will recognize that numerous modifications and alternative embodiments are within the scope of the disclosure. Moreover, although certain embodiments of the disclosure are described herein with respect to specific sheet product dispenser configurations, it will be appreciated that numerous other sheet product dispenser configurations are within the scope of the disclosure. Conditional language used herein, such as "can," "could," "might," or "may," unless specifically stated otherwise, or otherwise understood within the context as used, generally is intended to convey that certain embodiments include, while other embodiments do not include, certain features, elements, or functional capabilities. Thus, such conditional language generally is not intended to imply that certain features, elements, or functional capabilities are in any way required for all embodiments.

We claim:

1. A method of dispensing a user-determined length of sheet product from a roll of sheet product via a sheet product dispenser, the method comprising:

providing the roll of sheet product rotatably supported by the sheet product dispenser for dispensing sheet product therefrom, wherein the roll of sheet product rotates in response to a pull force applied to a tail portion of the roll of sheet product; and providing, via the sheet product dispenser, a pull force resistance opposing the rotation of the roll of sheet product, wherein the pull force resistance is between 36 grams-force and 96 grams-force throughout a majority of a life of the roll of sheet product.

2. The method of claim 1, wherein the pull force resistance is between 46 grams-force and 86 grams-force throughout a majority of the life of the roll of sheet product.

3. The method of claim 1, wherein the pull force resistance is between 56 grams-force and 76 grams-force throughout a majority of the life of the roll of sheet product.

4. The method of claim 1, wherein the pull force resistance is between 36 grams-force and 96 grams-force throughout the life of the roll of sheet product.

5. The method of claim 1, wherein the pull force resistance is between 46 grams-force and 86 grams-force throughout the life of the roll of sheet product.

6. The method of claim 1, wherein the pull force resistance is between 56 grams-force and 76 grams-force throughout the life of the roll of sheet product.

7. The method of claim 1, wherein the roll of sheet product is coreless.

8. The method of claim 1, wherein the sheet product comprises bath tissue.

9. The method of claim 8, wherein the bath tissue has a caliper of between 20 mils/8 ply and 160 mils/8 ply.

10. The method of claim 8, wherein the bath tissue has a caliper of between 20 mils/8 ply and 80 mils/8 ply.

11. The method of claim 1, wherein the pull force resistance is substantially constant throughout the life of the roll of sheet product.

12. The method of claim 1, wherein the pull force resistance varies by less than 30 grams-force throughout a majority of the life of the roll of sheet product.

13. The method of claim 1, wherein the pull force resistance varies by less than 15 grams-force throughout a majority of the life of the roll of sheet product.

14. The method of claim 1, wherein providing the pull force resistance comprises:

providing, via a roll support mechanism, a first pull force resistance opposing the rotation of the roll of sheet product; and providing, via a resistance mechanism, a second pull force resistance opposing the rotation of the roll of sheet product.

15. The method of claim 14, wherein the first pull force resistance increases throughout the life of the roll of sheet product.

16. The method of claim 15, wherein the second pull force resistance decreases throughout the life of the roll of sheet product.

17. The method of claim 16, wherein a rate of increase of the first pull force resistance is substantially equal to a rate of decrease of the second pull force resistance, such that a sum of the first pull force resistance and the second pull force resistance is substantially constant throughout the life of the roll.

18. The method of claim 14, wherein the first pull force resistance is substantially constant throughout the life of the roll of sheet product.

19. The method of claim 14, wherein the second pull force resistance is substantially constant throughout the life of the roll of sheet product.

20. The method of claim 14, wherein the first pull force resistance varies by less than 30 grams-force throughout a majority of the life of the roll of sheet product.

21. The method of claim 14, wherein the second pull force resistance varies by less than 30 grams-force throughout a majority of the life of the roll of sheet product.

22. The method of claim 14, wherein the roll support mechanism comprises a spindle configured to rotatably support the roll of sheet product, and wherein the spindle comprises a spindle shaft and a spindle sleeve configured to generate a frictional force therebetween as the spindle sleeve rotates with the roll of sheet product during dispensing.

23. The method of claim 14, wherein the resistance mechanism comprises an engagement member configured to frictionally engage an outer surface of the roll of sheet product during dispensing.

24. The method of claim 23, wherein the resistance mechanism further comprises a biasing member configured to bias the engagement member into engagement with the outer surface of the roll of sheet product throughout a majority of the life of the roll of sheet product to generate a frictional force therebetween.

25. The method of claim 14, wherein the resistance mechanism comprises an engagement member configured to frictionally engage an end surface of the roll of sheet product during dispensing.

26. The method of claim 14, wherein the resistance mechanism comprises an arm configured to frictionally engage an outer surface of the roll of sheet product during dispensing, and a spring configured to bias the arm into engagement with the outer surface of the roll of sheet product throughout a majority of the life of the roll of sheet product to generate a frictional force therebetween.

27. The method of claim 14, wherein the resistance mechanism comprises a load member and a pair of guide members, and wherein the load member is configured to slide along a path defined by the guide members due to the force of gravity into frictional engagement with the outer surface of the roll of sheet product throughout a majority of the life of the roll of sheet product to generate a frictional force therebetween.

28. A sheet product dispenser for dispensing a user-determined length of sheet product from a roll of sheet product, the sheet product dispenser comprising:

a roll support mechanism configured to rotatably support the roll of sheet product for dispensing sheet product therefrom via a pull force applied by a user to a tail portion of the roll of sheet product and to provide a first pull force resistance opposing the pull force applied by the user; and a resistance mechanism configured to engage a portion of the roll of sheet product and to provide a second pull force resistance opposing the pull force applied by the user;

wherein a sum of the first pull force resistance and the second pull force resistance is between 36 grams-force and 96 grams-force throughout a majority of a life of the roll of sheet product.

29. A sheet product dispenser for dispensing a length of sheet product from a roll of sheet product, the sheet product dispenser comprising:

a roll support mechanism configured to rotatably support the roll of sheet product for dispensing sheet product therefrom via a pull force applied by a user to a tail portion of the roll of sheet product and to provide a first pull force resistance opposing the pull force applied by the user; and a resistance mechanism configured to engage a portion of the roll of sheet product and to provide a second pull force resistance opposing the pull force applied by the user;

wherein a sum of the first pull force resistance and the second pull force resistance is substantially constant throughout a majority of a life of the roll of sheet product.

30. A method of dispensing a user-determined length of sheet product from a roll of sheet product via a sheet product dispenser, the method comprising:

providing the roll of sheet product rotatably supported by the sheet product dispenser for dispensing sheet product therefrom, wherein the roll of sheet product rotates in response to a pull force applied to a tail portion of the roll of sheet product;

providing, via a roll support mechanism, a first pull force resistance opposing the rotation of the roll of sheet product; and providing, via a resistance mechanism, a second pull force resistance opposing the rotation of the roll of sheet product;

wherein a sum of the first pull force resistance and the second pull force resistance is between 36 grams-force and 96 grams-force throughout a majority of a life of the roll of sheet product.

31. The method of claim 30, wherein the sum of the first pull force resistance and the second pull force resistance is between 46 grams-force and 86 grams-force throughout a majority of the life of the roll of sheet product.

32. The method of claim 30, wherein the sum of the first pull force resistance and the second pull force resistance is between 56 grams-force and 76 grams-force throughout a majority of the life of the roll of sheet product.

33. The method of claim 30, wherein the roll of sheet product is coreless, and wherein the sheet product comprises bath tissue.

34. The method of claim 30, wherein the first pull force resistance increases throughout the life of the roll of sheet product, and wherein the second pull force resistance decreases throughout the life of the roll of sheet product.

35. The method of claim 30, wherein the pull force resistance is substantially constant throughout the life of the roll of sheet product.

36. The method of claim 30, wherein the roll support mechanism comprises a spindle rotatably supporting the roll of sheet product, and wherein the resistance mechanism comprises an engagement member frictionally engaging an outer surface of the roll of sheet product during dispensing.

* * * * *